US009401111B2

(12) United States Patent
Kishi

(10) Patent No.: US 9,401,111 B2
(45) Date of Patent: Jul. 26, 2016

(54) DISPLAY DEVICE AND DRIVE METHOD THEREOF

(71) Applicant: Sharp Kabushiki Kaisha, Osaka (JP)

(72) Inventor: Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 65 days.

(21) Appl. No.: 14/358,719

(22) PCT Filed: Nov. 9, 2012

(86) PCT No.: PCT/JP2012/079102
§ 371 (c)(1),
(2) Date: May 15, 2014

(87) PCT Pub. No.: WO2013/073466
PCT Pub. Date: May 23, 2013

(65) Prior Publication Data

US 2014/0307012 A1 Oct. 16, 2014

(30) Foreign Application Priority Data

Nov. 17, 2011 (JP) ..... 2011-252113

(51) Int. Cl.
*G09G 3/3233* (2016.01)
*G09G 3/32* (2016.01)

(52) U.S. Cl.
CPC ..... *G09G 3/3241* (2013.01); *G09G 3/3233* (2013.01); *G09G 2300/0852* (2013.01); *G09G 2300/0861* (2013.01)

(58) Field of Classification Search
CPC ..... G09G 3/3233; G09G 3/3241; G09G 2300/0861; G09G 2300/0852
See application file for complete search history.

(56) References Cited

U.S. PATENT DOCUMENTS

2004/0174354 A1* 9/2004 Ono ..... G09G 3/3233 345/204
2007/0115225 A1* 5/2007 Uchino ..... G09G 3/3233 345/76

(Continued)

FOREIGN PATENT DOCUMENTS

JP 2004-280059 A 10/2004
JP 2007-148129 A 6/2007

(Continued)

OTHER PUBLICATIONS

International Search Report received for PCT Patent Application No. PCT/JP2012/079102, mailed on Feb. 5, 2013, 6 pages (3 pages of English translation and 3 pages of ISR).

*Primary Examiner* — Shaheda Abdin
(74) *Attorney, Agent, or Firm* — Morrison & Foerster LLP

(57) ABSTRACT

A pixel circuit 10 is provided with TFTs 12 and 13 and an organic EL element 15 on a current path connecting a power supply line VPk and an electrode having a common potential Vcom. A display device 100 simultaneously performs initialization to pixel circuits 10 in a plurality of rows, simultaneously perform threshold detection to the pixel circuits 10 in the plurality of rows, sequentially writes data to the pixel circuits 10 row by row, and makes the organic EL elements 15 included in the pixel circuits 10 in the plurality of rows emit light in the same period. In a period from completion of threshold detection to start of light emission, the TFTs 11 and 13 are controlled to an off state, and a potential VP_C which is substantially equal to the common potential Vcom is applied to the power supply line VPk. Consequently, leak current flowing through the TFTs 12 and 13 can be suppressed, and the fluctuation in the node potential in the pixel circuit 10 in a standby period can be prevented.

5 Claims, 19 Drawing Sheets

(56) References Cited

U.S. PATENT DOCUMENTS

| | | | | |
|---|---|---|---|---|
| 2009/0051628 | A1 | 2/2009 | Kwon | |
| 2010/0020065 | A1 | 1/2010 | Takasugi | |
| 2010/0045646 | A1* | 2/2010 | Kishi | G09G 3/3233 345/211 |
| 2011/0025586 | A1 | 2/2011 | Lee | |
| 2011/0025671 | A1 | 2/2011 | Lee | |
| 2012/0007848 | A1 | 1/2012 | Han et al. | |
| 2012/0249615 | A1 | 10/2012 | Lee | |

FOREIGN PATENT DOCUMENTS

| | | | |
|---|---|---|---|
| JP | 2011-34038 | A | 2/2011 |
| JP | 2011-34039 | A | 2/2011 |
| JP | 2012-208459 | A | 10/2012 |

* cited by examiner

DISPLAY DEVICE AND DRIVE METHOD THEREOF

CROSS REFERENCE TO RELATED APPLICATIONS

This is the U.S. National Phase patent application of PCT/JP2012/079102, filed Nov. 9, 2012, which claims priority to Japanese Patent Application No. 2011-252113, filed Nov. 17, 2011, each of which is hereby incorporated by reference in the present disclosure in its entirety.

TECHNICAL FIELD

The present invention relates to a display device and, more specifically, to a current drive type display device such as an organic EL display and a drive method of the same.

BACKGROUND ART

As a thin, high picture quality, and low power consumption display device, an organic EL (Electro Luminescence) display has been known. The organic EL display has a plurality of pixel circuits each including an organic EL element, a drive transistor, and a control transistor. As transistors in each pixel circuit, thin film transistors (hereinbelow, referred to as TFTs) are used.

In an organic EL display, variation occurs in a threshold voltage and a mobility of a drive transistor in a pixel circuit. Due to this, even when the same data potential is written to the pixel circuits, variation occurs in the amount of current flowing through the organic EL elements. Since the brightness of the organic EL element changes depending on the amount of current flowing through the organic EL element, when variation occurs in the amount of current flowing through the organic EL element, brightness unevenness occurs in a display screen. Therefore, to perform high-quality display in the organic EL display, a characteristic of the drive transistor has to be compensated. An organic EL display in which a characteristic of a drive transistor is compensated is described in, for example, Patent Document 1.

Another organic EL display has also been known in which all of organic EL elements emit light in the same period (for example, Patent Documents 2 and 3). In organic EL displays described in Patent Documents 2 and 3, at the head of one frame period, initialization is simultaneously performed to all of pixel circuits and threshold detection is simultaneously performed to all of the pixel circuits, next, data is sequentially written to the pixel circuits row by row, and organic EL elements included in all of the pixel circuits are made to emit light in the same period. FIG. 23 is a circuit diagram of a pixel circuit described in Patent Document 2. The pixel circuit illustrated in FIG. 23 includes TFTs 91 to 93, a capacitor 94, and an organic EL element 95.

PRIOR ART DOCUMENTS

Patent Documents

[Patent Document 1] Japanese Laid-Open Patent Publication No. 2007-148129

[Patent Document 2] Japanese Laid-Open Patent Publication No. 2011-34038

[Patent Document 3] Japanese Laid-Open Patent Publication No. 2011-34039

SUMMARY OF THE INVENTION

Problems to be Solved by the Invention

In pixel circuits of an organic EL display, the node potential in the pixel circuits has to be maintained except for the time of initialization, threshold detection, and data writing. Particularly, in an organic EL display in which initialization is simultaneously performed to pixel circuits in a plurality of rows, threshold detection is simultaneously performed to the pixel circuits in the plurality of rows, data is sequentially written to the pixel circuits row by row, and organic EL elements included in the pixel circuits in the plurality of rows are made to emit light in the same period, the node potential in the pixel circuits has to be maintained in a standby period from completion of the threshold detection to start of light emission. However, in an organic EL display of this type, an unignorable degree of leak current flows through TFTs in the standby period, which leads to a problem that the node potential in the pixel circuits fluctuates. For example, in the pixel circuit illustrated in FIG. 23, in the standby period, the TFTs 91 and 93 are in an off state, and the anode terminal of the organic EL element 95 enters a floating state. When the leak current flows through the TFT 93 in the standby period, the anode potential of the organic EL element 95 fluctuates. When the node potential in the pixel circuit fluctuates in the organic EL display, the brightness of the display screen fluctuates.

Therefore, an object of the present invention is to provide a display device in which the fluctuation of a node potential in a pixel circuit during a standby period is prevented.

Means for Solving the Problems

According to a first aspect of the present invention, there is provided a current drive type display device, including: a plurality of pixel circuits disposed in a row direction and a column direction; a plurality of scanning signal lines each connected to the pixel circuits in the same row; a plurality of data signal lines each connected to the pixel circuits in the same column; one or more control lines each connected to the pixel circuits in a plurality of rows; one or more power supply lines each connected to the pixel circuits in the plurality of rows; a drive circuit driving the scanning signal lines, the data signal lines, and the control line(s); and a power supply circuit selectively applying a plurality of potentials to the power supply line(s), wherein each of the pixel circuits includes: a light emitting element provided on a current path connecting the power supply line and a conductive member to which a common potential is applied, and having one end connected to the conductive member; and a drive transistor provided on the current path, and having one of conduction terminals connected to the other end of the light emitting element, the drive circuit and the power supply circuit simultaneously perform initialization to the pixel circuits in the plurality of rows, simultaneously perform threshold detection to the pixel circuits in the plurality of rows, sequentially write data to the pixel circuits row by row, and perform a control to make the light emitting elements included in the pixel circuits in the plurality of rows emit light in the same period, and the power supply circuit applies a first potential substantially equal to the common potential to the power supply line connected to the pixel circuit, in a period from completion of detecting threshold to start of light emission of the pixel circuit.

According to a second aspect of the present invention, in the first aspect of the present invention, the one end of the light emitting element is connected to the conductive member to which the common potential is fixedly applied, and the pixel circuit further includes: a write control transistor provided between the data signal line and a control terminal of the drive transistor, and having a control terminal connected to the scanning signal line; a light emission control transistor provided on the current path between the power supply line and the other conduction terminal of the drive transistor, and having a control terminal connected to the control line; and a capacitor provided between the control terminal and the conduction terminal on the light emitting element side of the drive transistor.

According to a third aspect of the present invention, in the second aspect of the present invention, the pixel circuit is controlled such that in an initialization period, the write control transistor and the light emission control transistor are in an on state, a potential with which the drive transistor enters an on state is applied to the data signal line, and a second potential for initialization is applied to the power supply line, in a threshold detection period, the write control transistor and the light emission control transistor are in the on state, a potential for threshold detection is applied to the data signal line, and a third potential for threshold detection is applied to the power supply line, in a period from completion of threshold detection to start of data writing and a period from completion of data writing to start of light emission, the write control transistor and the light emission control transistor are in an off state, in a data writing period, the write control transistor is in the on state, the light emission control transistor is in the off state, and a data potential is applied to the data signal line, and in a light emission period, the write control transistor is in the off state, the light emission control transistor is in the on state, and a fourth potential for light emission is applied to the power supply line.

According to a fourth aspect of the present invention, in the third aspect of the present invention, the potential for threshold detection is a potential obtained by adding a threshold voltage of the drive transistor to the common potential.

According to a fifth aspect of the present invention, in the first aspect of the present invention, the one end of the light emitting element is connected to the conductive member to which the common potential is fixedly applied, the other conduction terminal of the drive transistor is connected to the power supply line, and the pixel circuit further includes: a first capacitor having one end connected to a control terminal of the drive transistor; a write control transistor provided between the other end of the first capacitor and the data signal line, and having a control terminal connected to the scanning signal line; a threshold detection transistor provided between the control terminal and the conduction terminal on the light emitting element side of the drive transistor, and having a control terminal connected to the control line; and a second capacitor provided between the other end of the first capacitor and another power supply line having a predetermined potential.

According to a sixth aspect of the present invention, in the fifth aspect of the present invention, the pixel circuit is controlled such that in a former part of an initialization period, the write control transistor is in an on state and the first potential is applied to the power supply line, in a latter part of the initialization period, the write control transistor is in the on state, a potential with which the drive transistor enters an on state is applied to the data signal line, and a second potential for initialization is applied to the power supply line, in a threshold detection period, the write control transistor and the threshold detection transistor are in an on state, a potential for threshold detection is applied to the data signal line, and the first potential is applied to the power supply line, in a period from completion of threshold detection to start of data writing and a period from completion of data writing to start of light emission, the write control transistor and the threshold detection transistor are in an off state, in a data writing period, the write control transistor is in the on state, the threshold detection transistor is in the off state, and a data potential is applied to the data signal line, and in a light emission period, the write control transistor and the threshold detection transistor are in the off state, and a third potential for light emission is applied to the power supply line.

According to a seventh aspect of the present invention, in the first aspect of the present invention, the other conduction terminal of the drive transistor is connected to the power supply line, and the pixel circuit further includes: a capacitor having one end connected to a control terminal of the drive transistor; a write control transistor provided between the other end of the capacitor and the data signal line, and having a control terminal connected to the scanning signal line; a threshold detection transistor provided between the control terminal and the conduction terminal on the light emitting element side of the drive transistor; and a power supply connection transistor provided between the other end of the capacitor and the power supply line or another power supply line having a predetermined potential, and having a control terminal connected to the control line.

According to an eighth aspect of the present invention, in the seventh aspect of the present invention, the display device further includes one or more second control lines each connected to the pixel circuits in the plurality of rows, wherein a control terminal of the threshold detection transistor is connected to the second control line, the one end of the light emitting element is connected to the conductive member to which the common potential is fixedly applied, and the power supply circuit selectively applies three kinds of potentials to the power supply line(s).

According to a ninth aspect of the present invention, in the eighth aspect of the present invention, the pixel circuit is controlled such that in a former part of an initialization period, the write control transistor is in an on state, the power supply connection transistor is in an off state, and the first potential is applied to the power supply line, in a latter part of the initialization period, the write control transistor is in the on state, the power supply connection transistor is in the off state, a potential with which the drive transistor enters an on state is applied to the data signal line, and a second potential for initialization is applied to the power supply line, in a threshold detection period, the write control transistor and the threshold detection transistor are in an on state, the power supply connection transistor is in the off state, a potential for threshold detection is applied to the data signal line, and the first potential is applied to the power supply line, in a period from completion of threshold detection to start of data writing and a period from completion of data writing to start of light emission, the write control transistor and the power supply connection transistor are in the off state, in a data writing period, the write control transistor and the threshold detection transistor are in the on state, the power supply connection transistor is in the off state, and a data potential is applied to the data signal line, and in a light emission period, the write control transistor and the threshold detection transistor are in an off state, the power supply connection transistor is in an on state, and a third potential for light emission is applied to the power supply line.

According to a tenth aspect of the present invention, in the seventh aspect of the present invention, the display device further includes: one or more second control lines each connected to the pixel circuits in the plurality of rows; and one or more second power supply lines each connected to the pixel circuits in the plurality of rows and functioning as the conductive member, wherein a control terminal of the threshold detection transistor is connected to the second control line, the one end of the light emitting element is connected to the second power supply line, and the power supply circuit selectively applies two kinds of potentials to the power supply line(s) and the second power supply line(s) respectively.

According to an eleventh aspect of the present invention, in the seventh aspect of the present invention, a control terminal of the threshold detection transistor is connected to the scanning signal line, the one end of the light emitting element is connected to the conductive member to which the common potential is fixedly applied, and the power supply circuit selectively applies three kinds of potentials to the power supply line(s).

According to a twelfth aspect of the present invention, there is provided a drive method of a current drive type display device, including a plurality of pixel circuits disposed in a row direction and a column direction, a plurality of scanning signal lines each connected to the pixel circuits in the same row, a plurality of data signal lines each connected to the pixel circuits in the same column, one or more control lines each connected to the pixel circuits in a plurality of rows, and one or more power supply lines each connected to the pixel circuits in the plurality of rows, each of the pixel circuits including a light emitting element provided on a current path connecting the power supply line and a conductive member to which a common potential is applied, and having one end connected to the conductive member, and a drive transistor provided on the current path, and having one of conduction terminals connected to the other end of the light emitting element, the method including: a driving step of driving the scanning signal lines, the data signal lines, and the control line(s); and a power supply control step of selectively applying a plurality of potentials to the power supply line(s), wherein in the driving step and the power supply control step, initialization is simultaneously performed to the pixel circuits in the plurality of rows, threshold detection is simultaneously performed to the pixel circuits in the plurality of rows, data is sequentially written to the pixel circuits row by row, and a control is performed to make the light emitting elements included in the pixel circuits in the plurality of rows emit light in the same period, and in the power supply control step, a potential substantially equal to the common potential is applied to the power supply line connected to the pixel circuit, in a period from completion of detecting threshold to start of light emission of the pixel circuit.

Effects of the Invention

According to the first or twelfth aspect of the present invention, with respect to a pixel circuit provided by connecting a light emitting element and a drive transistor in series on a current path connecting a power supply line and a conductive member to which a common potential is applied, by applying a potential substantially equal to the common potential to the power supply line in a period from completion of threshold detection to start of light emission, fluctuation in the node potential in the pixel circuit in the standby period can be prevented, and fluctuation in brightness of a display screen can be prevented.

According to the second or third aspect of the present invention, with respect to a pixel circuit including three transistors, one capacitor, and a light emitting element, by applying a potential substantially equal to the common potential to a power supply line connected to the pixel circuit in a period from completion of threshold detection to start of light emission, fluctuation of the node potential in the pixel circuit in the standby period can be prevented, and fluctuation in brightness of a display screen can be prevented.

According to fourth aspect of the present invention, by suppressing current flowing through a light emitting element in a standby period, the fluctuation of the node potential in the pixel circuit in the standby period can be prevented, and fluctuation in the brightness of a display screen can be prevented.

According to the fifth or sixth aspect of the present invention, with respect to a pixel circuit including three transistors, two capacitors, and a light emitting element, by applying a potential substantially equal to the common potential to a power supply line connected to the pixel circuit in a period from completion of threshold detection to start of light emission, fluctuation of the node potential in the pixel circuit in the standby period can be prevented, and fluctuation in brightness of a display screen can be prevented.

According to the seventh aspect of the present invention, with respect to a pixel circuit including four transistors, one capacitor, and a light emitting element, by applying a potential substantially equal to the common potential to a power supply line connected to the pixel circuit in a period from completion of threshold detection to start of light emission, fluctuation of the node potential in the pixel circuit in the standby period can be prevented, and fluctuation in brightness of a display screen can be prevented.

According to the eighth or ninth aspect of the present invention, by using two kinds of control lines each connected to pixel circuits in a plurality of rows and one kind of power supply line(s) each connected to the pixel circuits in the plurality of rows, a display device in which light emitting elements in pixel circuits in a plurality of row are made to emit light in the same period can be configured. By using one kind of power supply line(s), the layout area of the power supply line can be reduced.

According to the tenth aspect of the present invention, by using two kinds of control lines each connected to pixel circuits in a plurality of rows and two kinds of power supply lines each connected to the pixel circuits in the plurality of rows, a display device in which light emitting elements in pixel circuits in a plurality of row are made to emit light in the same period can be configured. By using a power supply circuit selectively applying two kinds of potentials, the configuration of the power supply circuit can be simplified.

According to the eleventh aspect of the present invention, by using one kind of control line(s) each connected to pixel circuits in a plurality of rows and one kind of power supply line(s) each connected to the pixel circuits in the plurality of rows, a display device in which light emitting elements in pixel circuits in a plurality of row are made to emit light in the same period can be configured. By using one kind of control line(s) and one kind of power supply line(s), the layout area of the control line and the power supply line can be reduced, and the configuration of the drive circuit can be simplified.

MODES FOR CARRYING OUT THE INVENTION

First Embodiment

Figure 1:
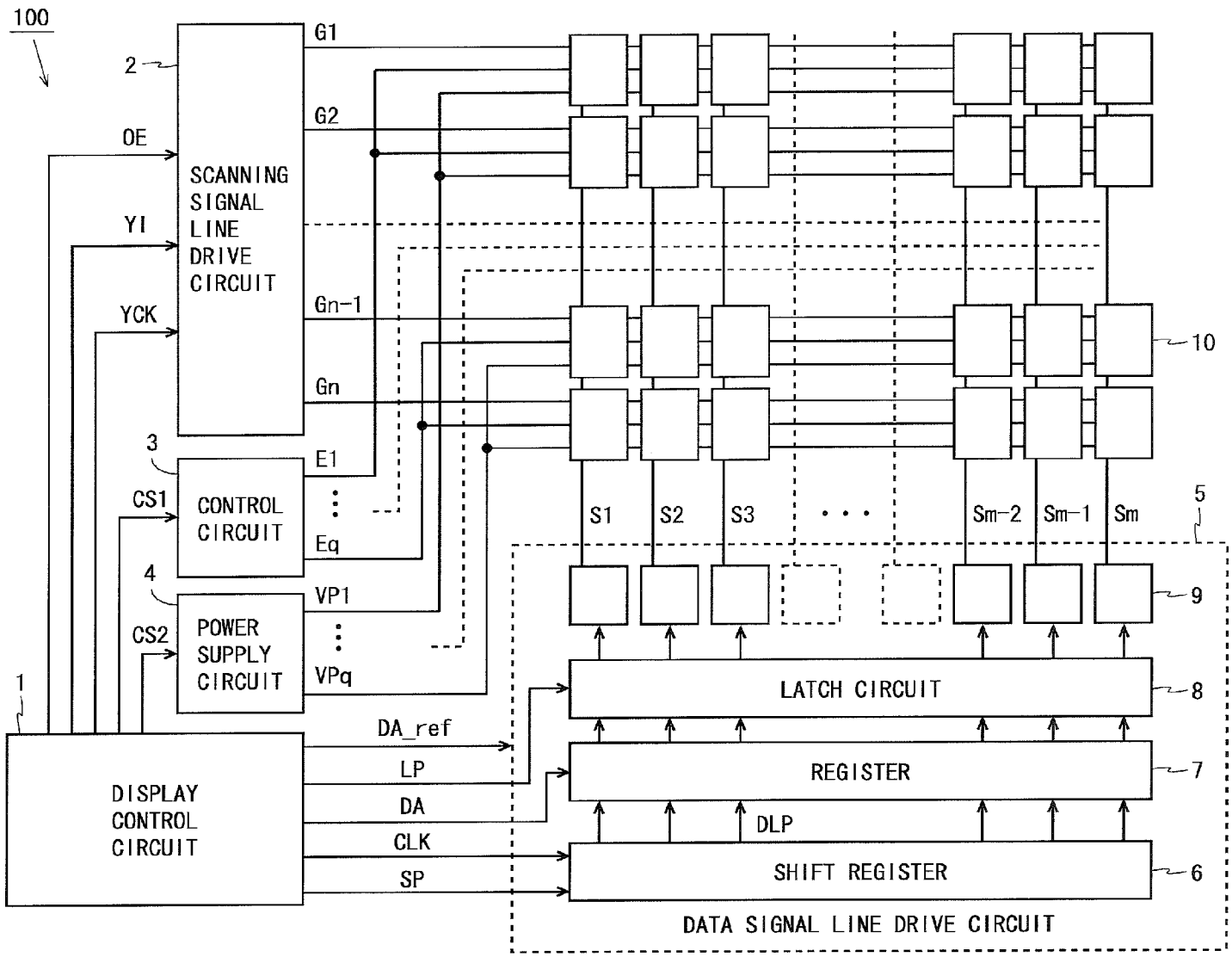
FIG. 1 is a block diagram illustrating a configuration of a display device according to a first embodiment of the present invention.

FIG. 1 is a block diagram illustrating a configuration of a display device according to a first embodiment of the present invention. A display device 100 illustrated in FIG. 1 is an organic EL display having a display control circuit 1, a scanning signal line drive circuit 2, a control circuit 3, a power supply circuit 4, a data signal line drive circuit 5, and (m×n) pieces of pixel circuits 10. The organic EL display is a kind of a current drive type display device. Hereinbelow, each of m and n is an integer of two or larger, each of i and q is an integer which is equal to or larger than one and is equal to or smaller than n, j is an integer which is equal to or larger than one and equal to or smaller than m, and k is an integer which is equal to or larger than one and is equal to or smaller than q.

The display device 100 is provided with n pieces of scanning signal lines G1 to Gn and m pieces of data signal lines S1 to Sm. The scanning signal lines G1 to Gn are disposed in parallel to one another, and the data signal lines S1 to Sm are disposed in parallel to one another so as to intersect with the scanning signal lines G1 to Gn perpendicularly. The pixel circuit 10 is disposed in the vicinity of each of cross points of the scanning signal lines G1 to Gn and the data signal lines S1 to Sm. In such a manner, the (m×n) pieces of pixel circuits 10 are disposed two-dimensionally. The scanning signal line Gi is connected to m pieces of pixel circuits 10 disposed in the i-th row, and the data signal line Sj is connected to n pieces of pixel circuits 10 disposed in the j-th column. The display device 100 is also provided with q pieces of control lines E1 to Eq and q pieces of power supply lines VP1 to VPq. The pixel circuits 10 in each row are connected to one of the control lines E1 to Eq and one of the power supply lines VP1 to VPq. To the pixel circuit 10, a common potential Vcom is supplied by using a not-illustrated conductive member (electrode).

The display control circuit 1 outputs control signals to the scanning signal line drive circuit 2, the control circuit 3, the power supply circuit 4, and the data signal line drive circuit 5. More specifically, the display control circuit 1 outputs a timing signal OE, a start pulse YI, and a clock YCK to the scanning signal line drive circuit 2, outputs a control signal CS1 to the control circuit 3, outputs a control signal CS2 to the power supply circuit 4, and outputs a start pulse SP, a clock CLK, a data signal DA, a latch pulse LP, and a reference signal DA_ref to the data signal line drive circuit 5. The data signal DA and the reference signal DA_ref are analog signals. The reference signal DA_ref has a predetermined reference potential.

The scanning signal line drive circuit 2 drives the scanning signal lines G1 to Gn. More specifically, the scanning signal line drive circuit 2 includes a shift register circuit, an logic operation circuit, and buffers (which are not illustrated). The shift register circuit sequentially transfers the start pulse YI in synchronization with the clock YCK. The logic operation circuit performs a logic operation between a pulse output from each of stages in the shift register circuit and the timing signal OE. The output of the logic operation circuit is supplied to the corresponding scanning signal line Gi via the buffer. With this, m pieces of pixel circuits 10 connected to the scanning signal line Gi are selected collectively.

The control circuit 3 selectively applies a high-level potential and a low-level potential to the control lines E1 to Eq based on the control signal CS1. The power supply circuit 4 selectively applies at least three kinds of potentials to the power supply lines VP1 to VPq based on the control signal CS2. More specifically, the power supply circuit 4 selectively applies a potential to each of the power supply lines VP1 to VPq, the potential being selected from among potentials VP_H1 and VP_H2 higher than the common potential Vcom, a potential VP_C substantially equal to Vcom, and a potential VP_L lower than Vcom. The potentials VP_H1 and VP_H2 may be the same.

The data signal line drive circuit 5 drives the data signal lines S1 to Sm. More specifically, the data signal line drive circuit 5 includes a shift register 6 having m bits, a register 7, a latch circuit 8, and m pieces of output buffers 9. The shift register 6 has a configuration in which m pieces of registers are connected in multiple stages. The start pulse SP supplied to the register in the first stage is transferred synchronously with the clock CLK, and timing pulses DLP are output from the registers in the stages. At the output timings of the timing pulses DLP, the data signal DA is supplied to the register 7.

The register 7 stores the data signal DA in accordance with the timing pulse DLP. When the data signals DA of one row are stored in the register 7, the display control circuit 1 outputs the latch pulse LP to the latch circuit 8. When the latch circuit 8 receives the latch pulse LP, the latch circuit 8 holds the data signals DA stored in the register 7. The m pieces of output buffers 9 are provided in correspondence with the data signal lines S1 to Sm. The output buffer 9 is typically an impedance conversion circuit such as a voltage follower. The output buffer 9 outputs, to the data signal line Sj, either one of the data signal DA held in the latch circuit 8 and the reference signal DA_ref output from the display control circuit 1.

Figure 2:
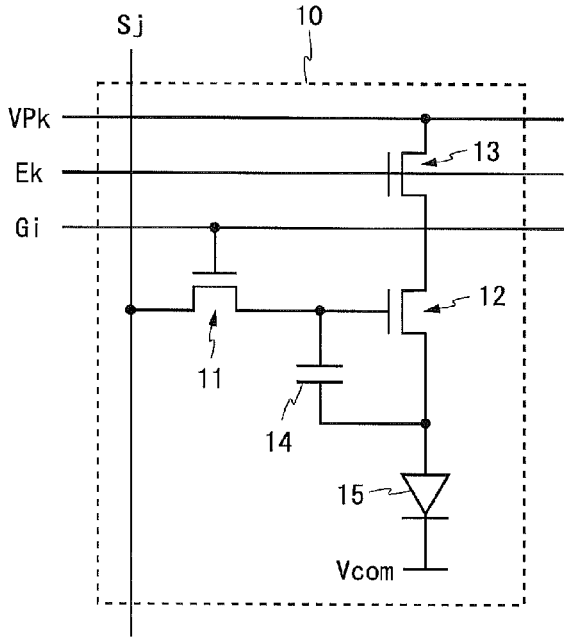
FIG. 2 is a circuit diagram of a pixel circuit included in the display device illustrated in FIG. 1.

FIG. 2 is a circuit diagram of the pixel circuit 10. As illustrated in FIG. 2, the pixel circuit 10 includes TFTs 11 to 13, a capacitor 14, and an organic EL element 15. Each of the TFTs 11 to 13 is an N-channel-type transistor. The pixel circuit 10 is connected to the scanning signal line Gi, the data signal line Sj, the control line Ek, the power supply line VPk, and an electrode having the common potential Vcom.

One of conduction terminals of the TFT 11 is connected to the data signal line Sj, and the other conduction terminal is connected to the gate terminal of the TFT 12. The drain terminal of the TFT 13 is connected to the power supply line VPk, and the source terminal is connected to the drain terminal of the TFT 12. The source terminal of the TFT 12 is connected to the anode terminal of the organic EL element 15. The cathode terminal of the organic EL element 15 is connected to the electrode having the common potential Vcom. The capacitor 14 is provided between the gate terminal and the source terminal (the conduction terminal on the organic EL element 15 side) of the TFT 12. The gate terminal of the TFT 11 is connected to the scanning signal line Gi, and the gate terminal of the TFT 13 is connected to the control line Ek. The TFTs 11 to 13 function as a write control transistor, a drive transistor, and a light emission control transistor, respectively, and the organic EL element 15 functions as a light emitting element.

Figure 3:
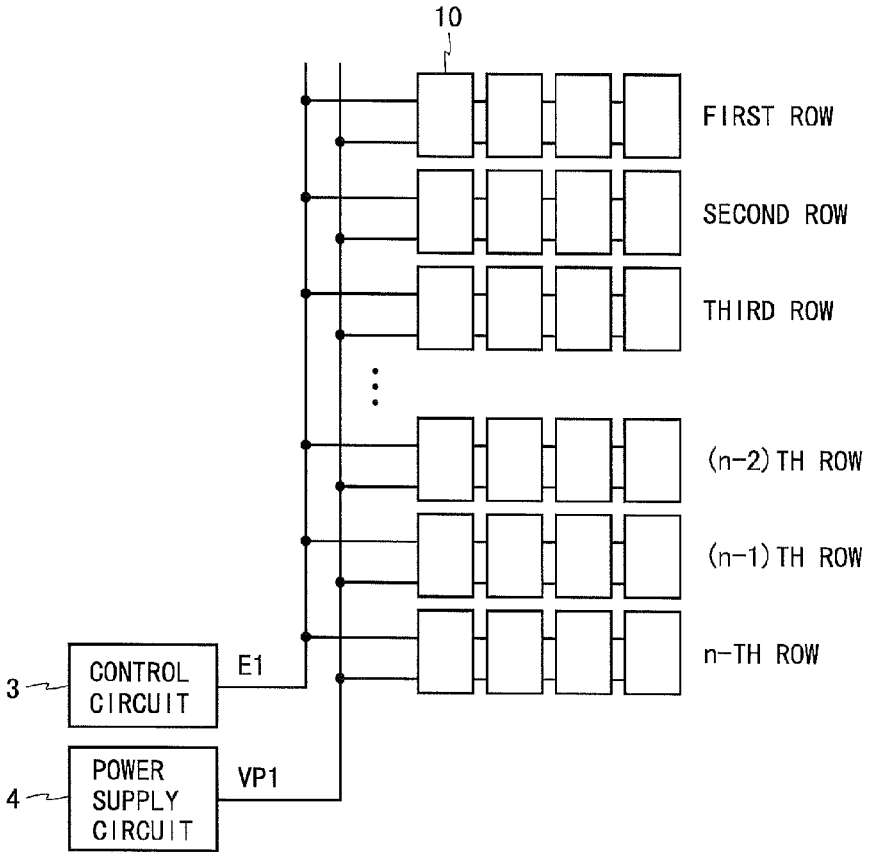
FIG. 3 is a diagram illustrating a connection form of a control line and a power supply line of the display device illustrated in FIG. 1.
Figure 4:
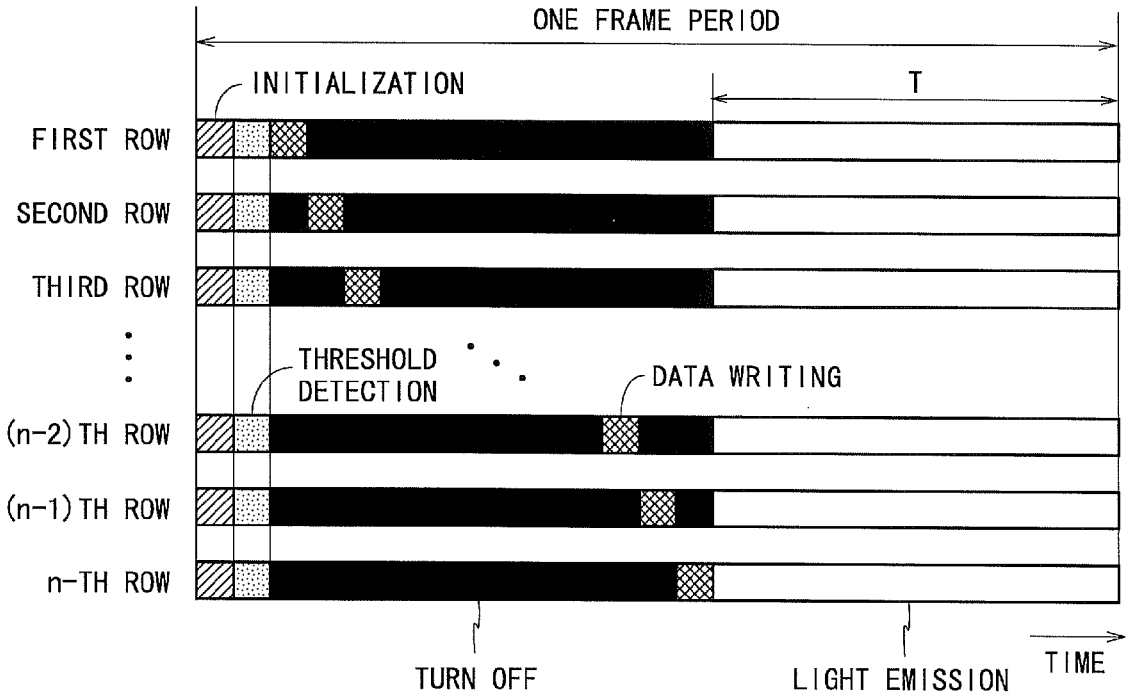
FIG. 4 is a diagram illustrating operations of pixel circuits in each row of the display device illustrated in FIG. 1.

Hereinbelow, the case where q=1 will be described. FIG. 3 is a diagram illustrating a connection form of the control line and the power supply line in the case of q=1. In this case, all of the pixel circuits 10 are connected to the control line E1 and the power supply line VP1. FIG. 4 is a diagram illustrating operations of the pixel circuits 10 in each row in the case of q=1. As illustrated in FIG. 4, an initialization period, a threshold detection period, a data writing period, a light emission period, and a turn off period are set in one frame period. The initialization period is a period of initializing the anode terminal of the organic EL element 15. The threshold detection period is a period of applying the reference potential to the data signal line Sj and detecting a threshold voltage of the TFT 12. The data writing period is a period of applying a data potential (potential corresponding to the data signal DA) to the data signal line Sj and writing the data potential to the pixel circuit 10. Hereinbelow, a period from completion of threshold detection to start of data writing will be called a data standby period, a period from completion of data writing to start of light emission will be called a light emission standby period, and both of the periods will be called a standby period.

As illustrated in FIG. 4, at the head of one frame period, initialization and threshold detection are performed to all of the pixel circuits 10. Next, data writing to the pixel circuits 10 is sequentially performed row by row. After completion of data writing to all of the pixel circuits 10, the organic EL elements 15 in all of the pixel circuits 10 emit light for the same time T. The pixel circuits 10 have to complete light emission before initialization starts in the following frame period. While satisfying the condition, to adjust the light emission periods of all of the pixel circuits 10, the light emission period is, at the longest, a period obtained by excluding the initialization period, the threshold detection period, and n pieces of the data writing periods from one frame period.

Figure 5:
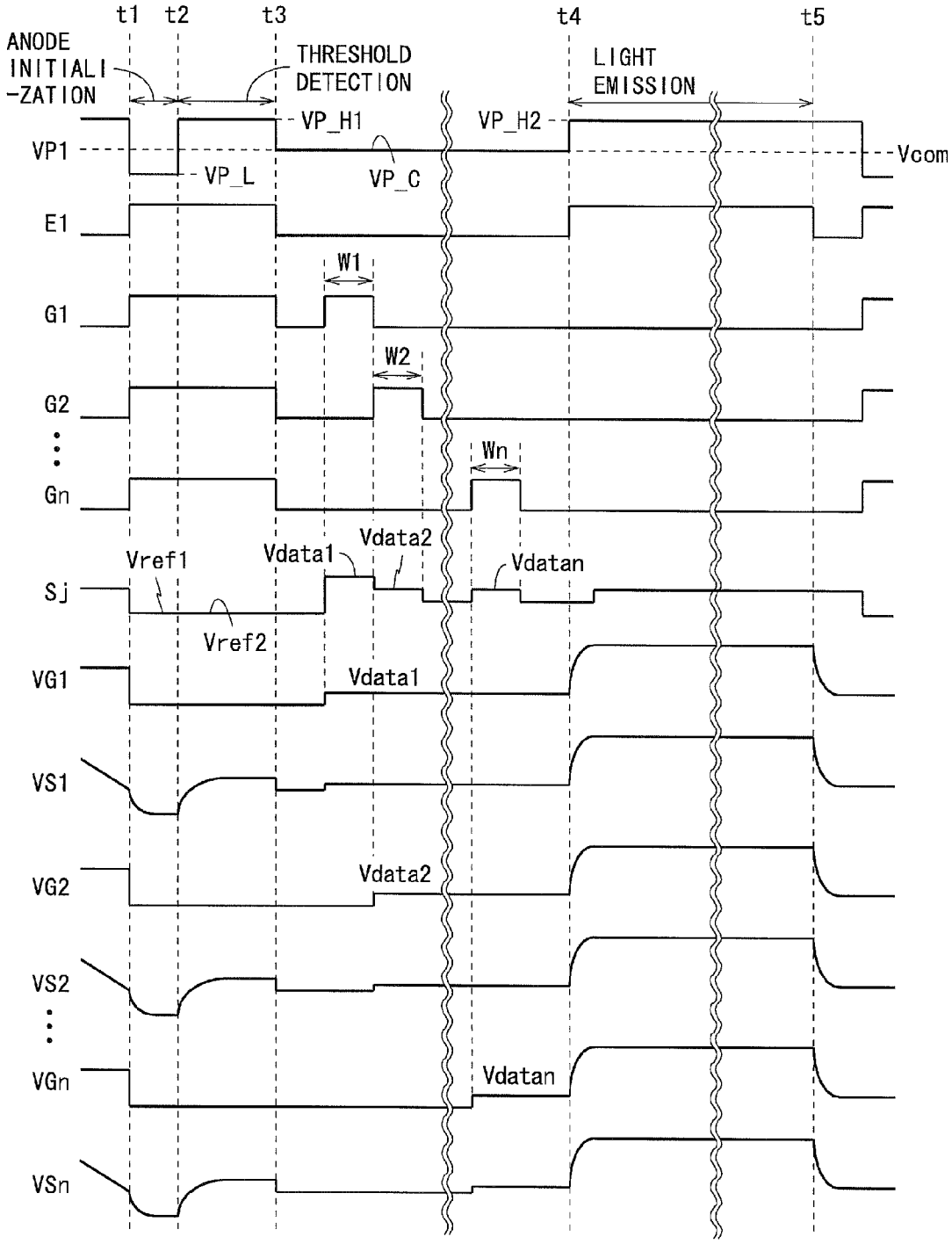
FIG. 5 is a timing chart of the display device illustrated in FIG. 1.

FIG. 5 is a timing chart illustrating the operations of the pixel circuits 10. In FIG. 5, Wi represents a data writing period of the pixel circuits 10 in the i-th row. VGi represents the gate potential of the TFT 12 in the pixel circuit 10 in the i-th row, and VSi represents the source potential of the TFT 12 (that is, the anode potential of the organic EL element 15) in the pixel circuit 10 in the i-th row.

Hereinafter, with reference to FIG. 5, the operations of the pixel circuit 10 connected to the scanning signal line Gi, the data signal line Sj, the control line E1, and the power supply line VP1 will be described. Before time t1, the potentials of the scanning signal line Gi and the control line E1 are at the low level, and the potential of the power supply line VP1 is VP_H2 higher than the common potential Vcom.

(a) Anode Initialization

At time t1, the potentials of the scanning signal line Gi and the control line E1 change to the high level. With the change, the TFTs 11 and 13 change to an on state. Between time t1 and time t2, the potential of the power supply line VP1 becomes VP_L lower than the common potential Vcom, and the potential of the data signal line Sj becomes Vref1. Consequently, the gate potential of the TFT 12 becomes Vref1. The potential Vref1 is determined such that the TFT 12 enters an on state sufficiently. Therefore, the anode potential of the organic EL element 15 becomes substantially equal to VP_L.

(b) Threshold Detection

At time t2, the potential of the power supply line VP1 changes to VP_H1 higher than the common potential Vcom, and the potential of the data signal line Sj changes to Vref2. Consequently, the gate potential of the TFT 12 changes to Vref2. The potential Vref2 is determined such that the TFT 12 enters an on state and a voltage applied to the organic EL element 15 becomes lower than a light emission threshold voltage. Therefore, after time t2, current flows from the power supply line VP1 into the anode terminal of the organic EL element 15 through the TFTs 13 and 12, and the anode potential of the organic EL element 15 rises. Since no current flows through the organic EL element 15, when the threshold voltage of the TFT 12 is assumed to be Vth, the anode potential of the organic EL element 15 rises to (Vref2−Vth).

In the display device 100 according to the embodiment, a potential to be supplied to the pixel circuit 10 is determined such that the anode potential (Vref2−Vth) of the organic EL element 15 after the threshold detection becomes substantially equal to the common potential Vcom. Concretely, when the average value of the threshold voltage of the TFT 12 in the display device 100 is assumed to be Vth_ave, the potential Vref2 is determined so as to satisfy the following equation (1).

$$V\text{com}=V\text{ref2}-V\text{th_ave} \quad (1)$$

As the average value Vth_ave of the threshold voltage, a target value of the threshold voltage or a value obtained by modifying the target value of the threshold voltage based on an actually measured value may be used.

In the case of using the potential Vref2 satisfying the equation (1), the current passing through the organic EL element 15 does not flow easily in the standby period. In the case where the threshold voltage Vth is apart from the average value, leak current flows from the anode terminal of the organic EL element 15. However, generally, the difference between the threshold voltage Vth and the average value is a few mV to hundreds mV, so that the amount of the leak current is not so large. By using the potential Vref2 satisfying the equation (1), the amount of leak current can be reduced sufficiently.

(c) Data Standby

At time t3, the potentials of the scanning signal line Gi and the control line E1 change to the low level. With the change, the TFTs 11 and 13 change to an off state. Ideally, in the data standby period, the current does not flow from the anode terminal of the organic EL element 15 to either of the organic EL element 15 side or the power supply line VP1 side, and the anode potential of the organic EL element 15 maintains at (Vref2−Vth). However, without any special contrivance, an unignorable degree of leak current flows through the TFTs 12 and 13 in the data standby period, and the anode potential of the organic EL element 15 fluctuates.

Therefore, for a period from completion of the threshold detection to start of light emission, the display device 100 according to the embodiment controls the TFT 13 to the off state and also sets the potential of the power supply line VP1 to VP_C which is substantially equal to the common potential Vcom. With this, in the standby period, leak current can be prevented from flowing from the anode terminal of the organic EL element 15 to the power supply line VP1, and the anode potential of the organic EL element 15 can be maintained constant.

(d) Data Writing

The data writing period Wi of the pixel circuits 10 in the i-th row is set in a period from time t3 to time t4. In the data writing period Wi, the potential of the scanning signal line Gi becomes the high level, and the potential of the data signal line Sj becomes a data potential Vdata. At this time, the TFT 11 is in the on state, so that the gate potential of the TFT 12 changes to Vdata. On the other hand, since the organic EL element 15 has a capacitance value sufficiently larger than that of the capacitor 14, even when the gate potential of the TFT 12 changes, the anode potential of the organic EL element 15 is hardly influenced.

Concretely, a gate-source voltage Vgs of the TFT 12 to which data has been written is given by the following equation (2).

$$Vgs=\{C_{OLED}/(C_{OLED}+C_{st})\}\times(V\text{data}-V\text{ref2})+Vth \quad (2)$$

In the equation (2), $C_{OLED}$ is a capacitance value of the organic EL element 15, and $C_{st}$ is a capacitance value between the gate and source of the TFT 12 (including the capacitance of the capacitor 14 and parasitic capacitance of the TFT 12). When $C_{OLED}>>C_{st}$, the following equation (3) is derived from the equation (2).

$$Vgs=V\text{data}-V\text{ref2}+Vth \quad (3)$$

(e) Light Emission Standby

In the light emission standby period, like the data standby period, the potentials of the scanning signal line Gi and the control line E1 become the low level, and the potential of the power supply line VP1 becomes VP_C which is substantially equal to the common potential Vcom. In the light emission standby period and the light emission period, the gate-source voltage Vgs of the TFT 12 is maintained at (Vdata−Vref2+Vth) by the action of the capacitor 14.

(f) Light Emission

At time t4, the potential of the control line E1 changes to the high level. With this change, the TFT 13 changes to the on state. At time t4, the potential of the power supply line VP1 changes to VP_H2 which is higher than the common potential Vcom. Consequently, after time t4, current flows from the power supply line VP1 into the anode terminal of the organic EL element 15 through the TFTs 13 and 12, and the anode potential of the organic EL element 15 rises. Since the gate terminal of the TFT 12 at this time is in the floating state, the gate potential of the TFT 12 rises by the same amount as the anode potential of the organic EL element 15. The gate-source voltage Vgs of the TFT 12 is maintained substantially constant.

The potential VP_H2 is determined such that the TFT 12 operates in a saturation region in the light emission period. Consequently, current I flowing through the organic EL element 15 in the light emission period is given by the following equation (4) when a channel length modulation effect is ignored.

$$I=\tfrac{1}{2}\cdot W/L\cdot\mu\cdot Cox(Vgs-Vth)^2 \quad (4)$$

In the equation (4), W is a gate width, L is a gate length, μ is a carrier mobility, and Cox is a gate oxide film capacitance. From the equations (3) and (4), the following equation (5) is derived.

$$I=\tfrac{1}{2}\cdot W/L\cdot\mu\cdot Cox(V\text{data}-V\text{ref2})^2 \quad (5)$$

Although the current I in the equation (5) changes depending on the data potential Vdata, it does not depend on the threshold voltage Vth of the TFT 12. Therefore, even in the case where variation occurs in the threshold voltage Vth or in the case where the threshold voltage Vth changes with time, by making current which does not depend on the threshold voltage Vth flow through the organic EL element 15, the organic EL element 15 can be made to emit light at desired brightness.

(g) Turn Off

At time t5, the potential of the control line E1 changes to the low level. With this change, the TFT 13 changes to the off state. Consequently, after time t5, the anode potential of the organic EL element 15 and the gate potential of the TFT 12 fall. After a while from time t5, the anode potential of the organic EL element 15 becomes sufficiently low, and the organic EL element 15 turns off.

In the display device 100 according to the embodiment, in the period from completion of the threshold detection to start of light emission, the potential VP_C which is substantially equal to the common potential Vcom is applied to the power supply line VPk. With this, in the standby period, the leak current can be prevented from flowing from the anode terminal of the organic EL element 15 to the power supply line VP1, and the anode potential of the organic EL element 15 can be maintained constant.

As illustrated in FIG. 4, the length of the data standby period and that of the light emission standby period of the pixel circuits 10 vary among the rows. For example, the length of the data standby period of the pixel circuits 10 in the first row is substantially zero, and the data standby period of the pixel circuits 10 in the n-th row is the longest. In the display device 100 according to the embodiment, even in the case where the length of the data standby period and that of the light emission standby period are different from each other, variations of brightness of a display screen can be suppressed by maintaining the anode potential of the organic EL element 15 constant in the standby period.

As described above, the display device 100 according to the embodiment includes the plurality of pixel circuits 10 disposed in the row direction and the column direction; the plurality of scanning signal lines G1 to Gn each connected to the pixel circuits 10 in the same row; the plurality of data signal lines S1 to Sm each connected to the pixel circuits 10 in the same column; one or more control lines E1 to Eq each connected to the pixel circuits 10 in a plurality of rows; one or more power supply lines VP1 to VPq each connected to the pixel circuits 10 in the plurality of rows; a drive circuit (a circuit configured by the scanning signal line drive circuit 2, the control circuit 3, and the data signal line drive circuit 5) driving the scanning signal lines, the data signal lines, and the control line(s); and the power supply circuit 4 selectively applying a plurality of potentials to the power supply line (s) VP1 to VPq.

The pixel circuit 10 includes a light emitting element (organic EL element 15) provided on a current path connecting the power supply line VPk and a conductive member (electrode) to which the common potential Vcom is applied, and having one end connected to the conductive member; a drive transistor (TFT 12) provided on the current path, and having one of conduction terminals connected to the other end of the light emitting element; a write control transistor (TFT 11) provided between the data signal line Sj and the control terminal of the drive transistor and having a control terminal connected to the scanning signal line Gi; a light emission control transistor (TFT 13) provided on the current path between the power supply line VPk and the other conduction terminal of the drive transistor, and having a control terminal connected to the control line Ek; and the capacitor 14 provided between the control terminal and the conduction terminal on the light emitting element side of the drive transistor (the source terminal of the TFT 12). The one end of the light emitting element (the cathode terminal of the organic EL element 15) is connected to the conductive member to which the common potential Vcom is fixedly applied.

The drive circuit and the power supply circuit 4 simultaneously perform initialization to pixel circuits 10 in the plurality of rows, simultaneously perform threshold detection to the pixel circuits 10 in the plurality of rows, sequentially write data to the pixel circuits 10 row by row, and perform a control to make light emitting elements included in the pixel circuits 10 in the plurality of rows emit light in the same period. The power supply circuit 4 applies the potential VP_C substantially equal to the common potential Vcom to the power supply line VPk connected to the pixel circuit 10, in a period from completion of detecting threshold to start of light emission of the pixel circuit 10.

In the display device 100 according to the embodiment, with respect to the pixel circuit 10 including three transistors, one capacitor, and a light emitting element, by applying the potential VP_C which is substantially equal to the common potential Vcom to the power supply line VPk in a period from completion of threshold detection to start of light emission, fluctuation of the node potential in the pixel circuit 10 in the standby period can be prevented, and fluctuation in brightness of a display screen can be prevented.

Hereinafter, the case of q>1 will be described as a modification of the display device 100 according to the embodiment. As examples, the case of q=2 (first and second modifications) and the case of q=3 (third modification) will be described. As will be described, by using two or more control lines and two or more power supply lines, the data writing period and the light emission period can be made longer than those in the case of using one control line and one power supply line.

Figure 6:
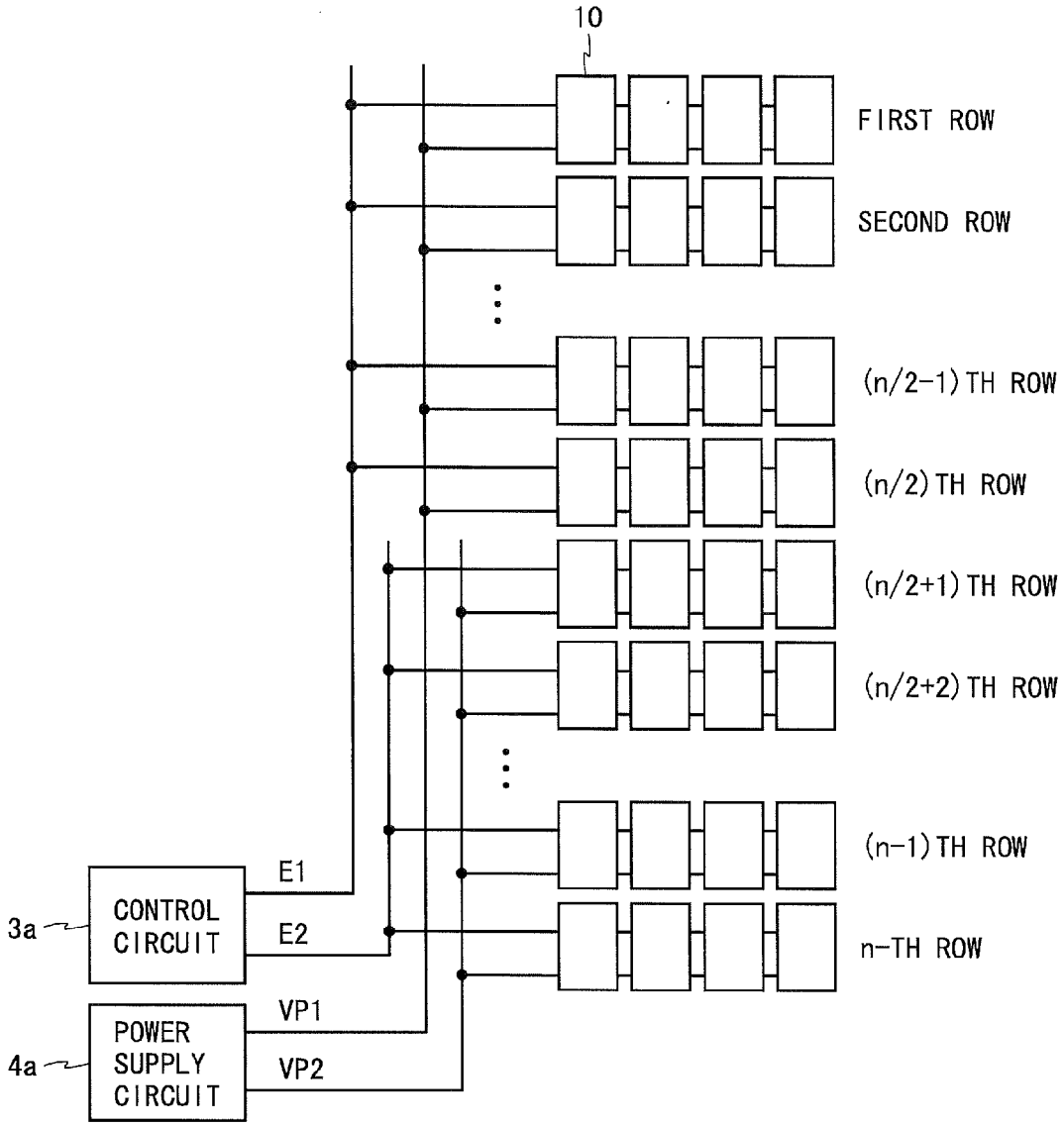
FIG. 6 is a diagram illustrating a connection form of control lines and power supply lines in a display device according to a first modification.

FIG. 6 is a diagram illustrating a connection form of control lines and power supply lines in a display device according to a first modification. In this case, the pixel circuits in the first to (n/2)th rows are connected to the control line E1 and the power supply line VP1, and the pixel circuits in the (n/2+1)th to n-th rows are connected to the control line E2 and the power supply line VP2. The scanning signal line drive circuit 2, a control circuit 3*a*, a power supply circuit 4*a*, and the data signal line drive circuit 5 perform a control such that the pixel circuits 10 in each row perform the following operations.

Figure 7:
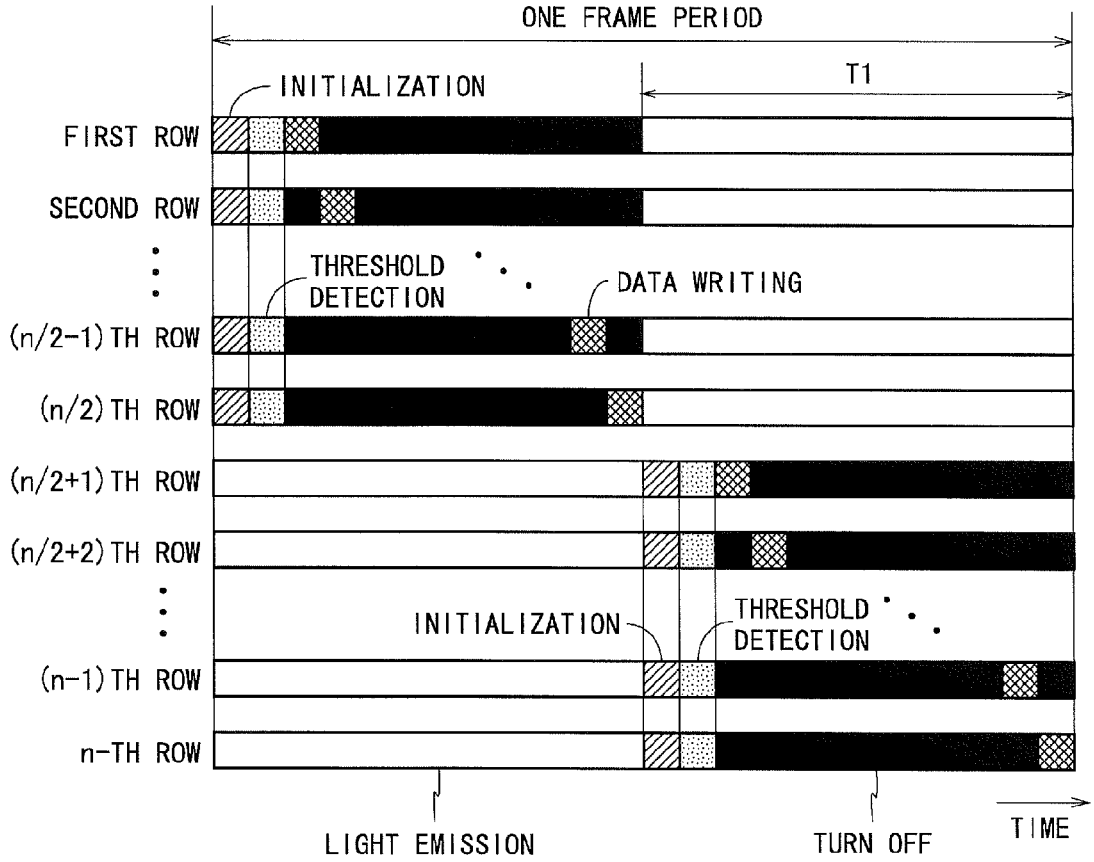
FIG. 7 is a diagram illustrating operations of pixel circuits in each row of the display device according to the first modification.

FIG. 7 is a diagram illustrating the operations of the pixel circuits 10 in each row in the display device according to the first modification. As illustrated in FIG. 7, one frame period is divided into a first period (former part) and a second period (latter part). At the head of the first period, initialization and threshold detection are performed to pixel circuits in the first to (n/2)th rows. At the head of the second period, initialization and threshold detection are performed to pixel circuits in the (n/2+1)th to n-th rows. After the first threshold detection, data writing to the pixel circuits in the first to (n/2)th rows is sequentially performed row by row. After the second threshold detection, data writing to the pixel circuits in the (n/2+1)th to n-th rows is sequentially performed row by row. The pixel circuits in the first to (n/2)th rows emit light for time T1 in the second period, and the pixel circuits in the (n/2+1)th to n-th rows emit light for the same time in the first period.

In the display device according to the first modification, in a period obtained by excluding the initialization period and the threshold detection period from the ½ frame period, data writing is performed to pixel circuits in the half of the whole. Therefore, in the display device according to the first modification, by making the period of writing data to the pixel circuits in the rows longer, data writing can be performed more easily.

Figure 8:
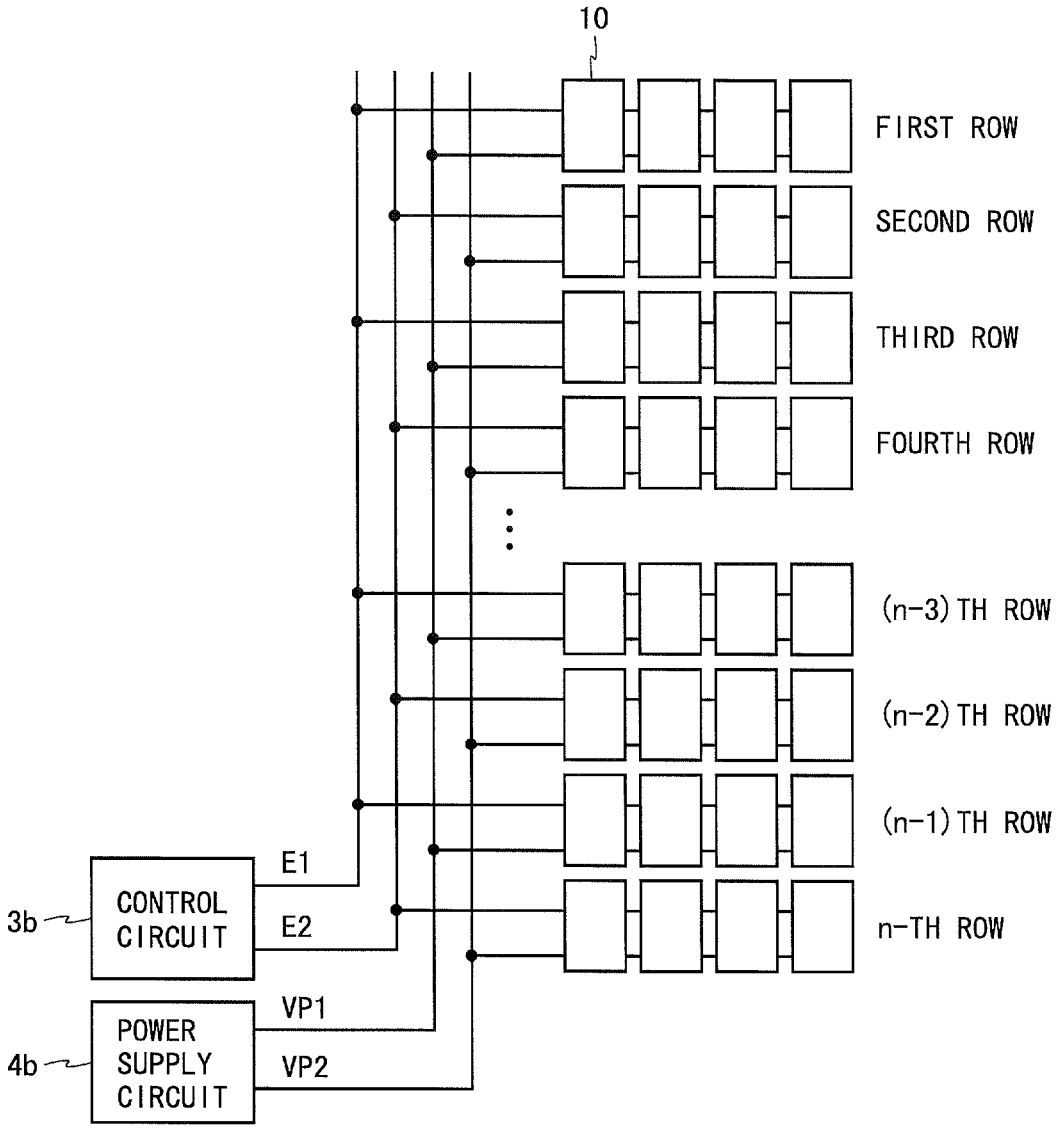
FIG. 8 is a diagram illustrating a connection form of control lines and power supply lines in a display device according to a second modification.

FIG. 8 is a diagram illustrating a connection form of control lines and power supply lines in a display device according to a second modification. In this case, the pixel circuits in the odd-numbered rows are connected to a control line E1 and a power supply line VP1, and the pixel circuits in the even-numbered rows are connected to a control line E2 and a power supply line VP2. The scanning signal line drive circuit 2, a control circuit 3*b*, a power supply circuit 4*b*, and the data signal line drive circuit 5 perform a control such that the pixel circuits 10 in each row perform the following operations.

Figure 9:
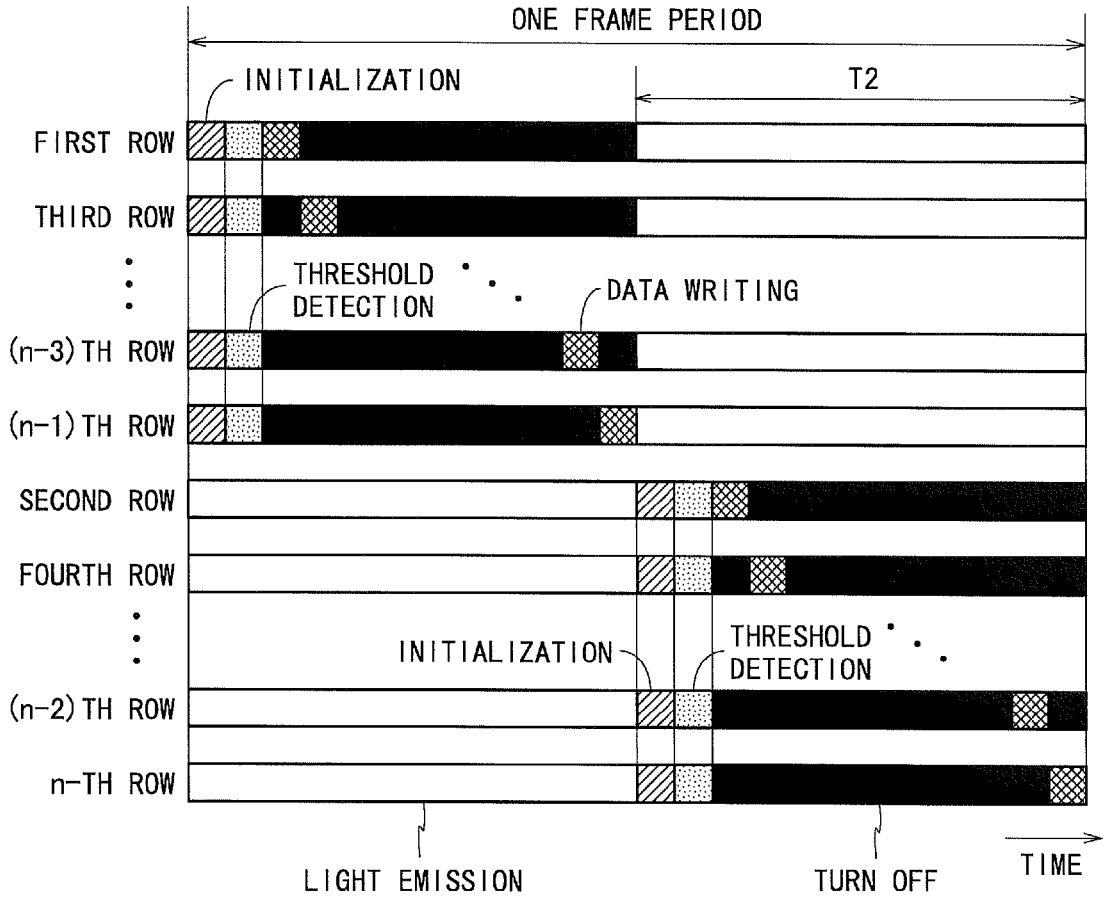
FIG. 9 is a diagram illustrating operations of pixel circuits in each row of the display device according to the second modification.

FIG. 9 is a diagram illustrating the operations of the pixel circuits 10 in each row in the display device according to the second modification. As illustrated in FIG. 9, one frame period is divided into first and second periods. At the head of the first period, initialization and threshold detection are performed to the pixel circuits in the odd-numbered rows. At the head of the second period, initialization and threshold detection are performed to the pixel circuits in the even-numbered rows. After the first threshold detection, data writing to the pixel circuits in the odd-numbered rows is sequentially performed row by row. After the second threshold detection, data writing to the pixel circuits in the even-numbered rows is sequentially performed row by row. The pixel circuits in the odd-numbered rows emit light for time T2 in the second period, and the pixel circuits in the even-numbered rows emit light for the same time in the first period.

In the display device according to the second modification, like the display device according to the first modification, by making the period of writing data to the pixel circuits in the rows longer, data writing can be performed more easily. Also in the case where the brightness in the upper half of the screen and that in the lower half are largely different from each other, the amounts of current flowing through the power supply lines VP1 and VP2 become substantially the same. Therefore, in the display device according to the second modification, the brightness difference which occurs in the center of the screen can be prevented.

Figure 10:
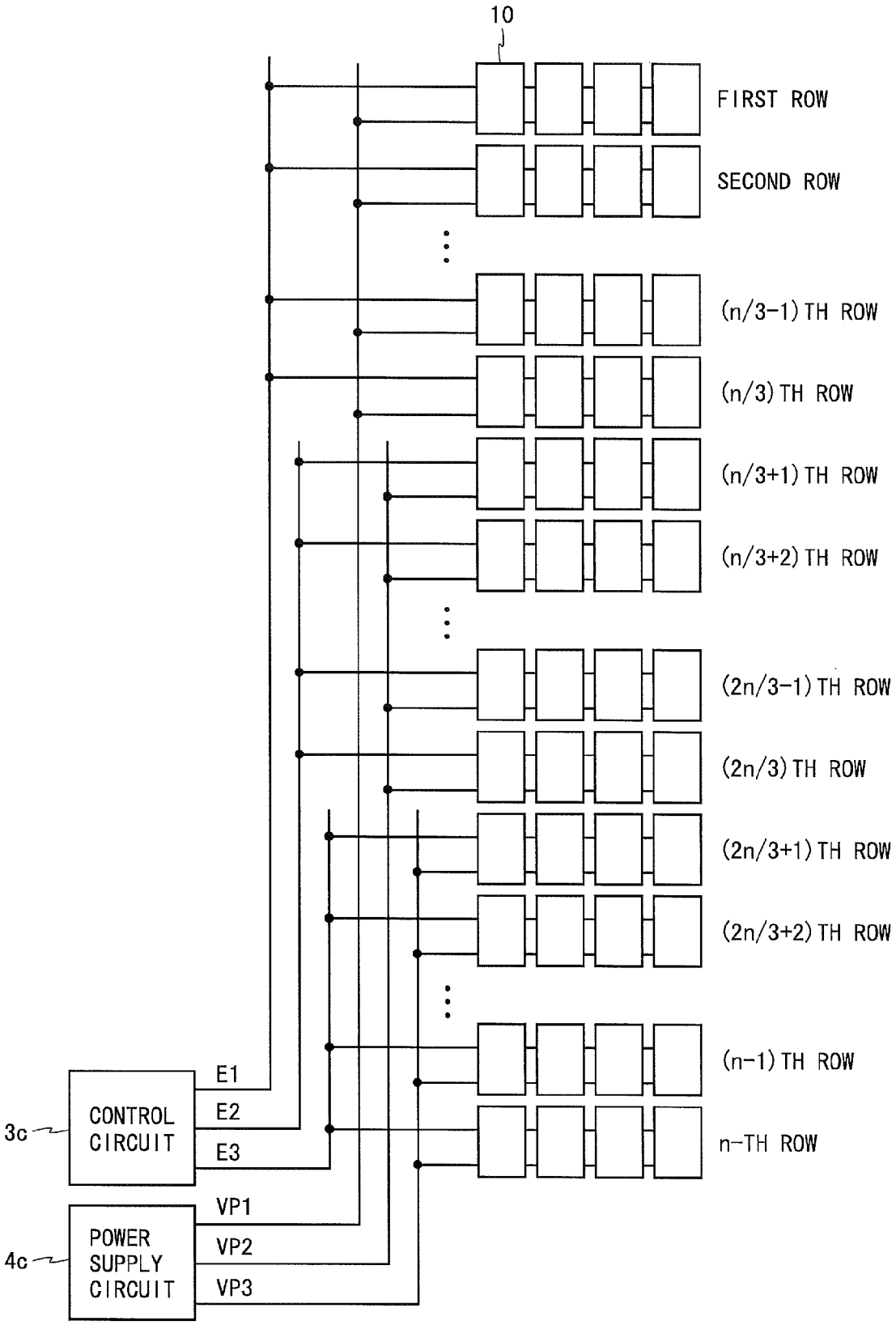
FIG. 10 is a diagram illustrating a connection form of control lines and power supply lines of a display device according to a third modification.

FIG. 10 is a diagram illustrating a connection form of control lines and power supply lines in a display device according to a third modification. In this case, the pixel circuits in the first to (n/3)th rows are connected to a control line E1 and a power supply line VP1, the pixel circuits in the (n/3+1)th to (2n/3)th rows are connected to a control line E2 and a power supply line VP2, and the pixel circuits in the (2n/3+1)th to n-th rows are connected to a control line E3 and a power supply line VP3. The scanning signal line drive circuit 2, a control circuit 3*c*, a power supply circuit 4*c*, and the data signal line drive circuit 5 perform a control such that the pixel circuits 10 in each row perform the following operations.

Figure 11:
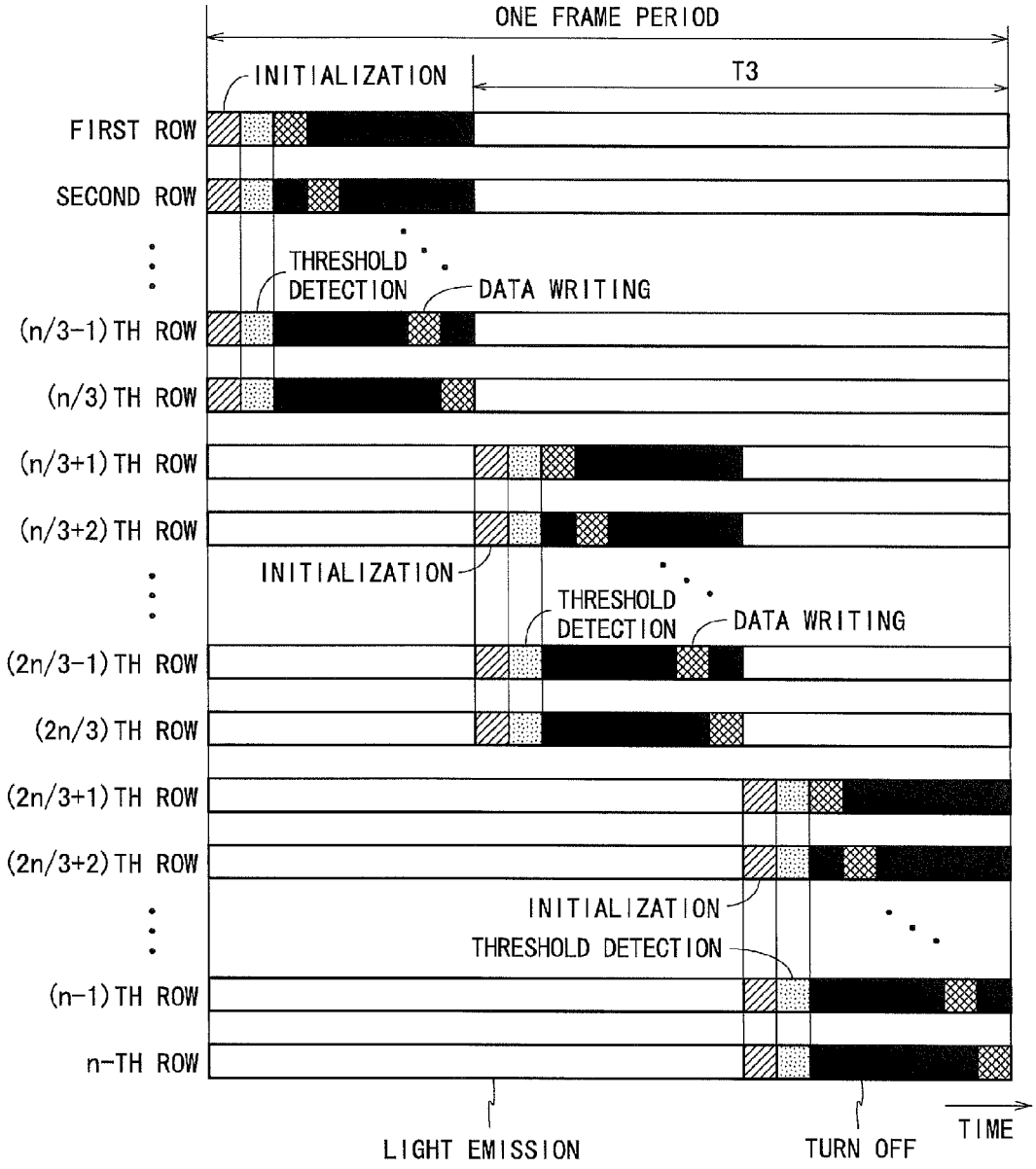
FIG. 11 is a diagram illustrating operations of pixel circuits in each row of the display device according to the third modification.

FIG. 11 is a diagram illustrating the operations of the pixel circuits 10 in each row of the display device according to the third modification. As illustrated in FIG. 11, one frame period is divided into first to third periods. At the head of the first period, initialization and threshold detection are performed to pixel circuits in the first to (n/3)th rows. At the head of the second period, initialization and threshold detection are performed to pixel circuits in the (n/3+1)th to (2n/3)th rows. At the head of the third period, initialization and threshold detection are performed to pixel circuits in the (2n/3+1)th to n-th rows. After the first threshold detection, data writing to the pixel circuits in the first to (n/3)th rows is sequentially performed row by row. After the second threshold detection, data writing to the pixel circuits in the (n/3+1)th to (2n/3)th rows is sequentially performed row by row. After the third threshold detection, data writing to the pixel circuits in the (2n/3+1)th to n-th rows is sequentially performed row by row. The pixel circuits in the first to (n/3)th rows emit light for time T3 in the second and third periods, the pixel circuits in the (n/3+1)th to (2n/3)th rows emit light for the same time in the third and first periods, and the pixel circuits in the (2n/3+1)th to n-th rows emit light for the same time in the first and second periods.

In the display device according to the third modification, the pixel circuits 10 are divided into three groups. During initialization and threshold detection to the pixel circuits in a certain group, the pixel circuits in the remaining two groups emit light. Therefore, in the display device according to the third modification, the light emission period can be increased to ⅔ frame period at the longest.

The value of q may be four or more. In the case of q≥4, the connection form of the control lines E1 to Eq and the power supply lines VP1 to VPq and the operations of the pixel circuits 10 in each row are similar to the above. In the case of q≥3, pixel circuits in the (n/q) rows adjacent in the column direction may be connected to the same control line and the same power supply line. Alternatively, pixel circuits in the (n/q) rows including every q-th row in the column direction may be connected to the same control line and the same power supply line. For example, in the case of q=3, the pixel circuits in the first row, the fourth row, and so on are connected to the control line E1 and the power supply line VP1, the pixel circuits in the second row, the fifth row, and so on are connected to the control line E2 and the power supply line VP2, and the pixel circuits in the third row, the sixth row, and so on are connected to the control line E3 and the power supply line VP3.

In the case of q=1, the initialization period, the threshold detection period, and the light emission period are common to all of the pixel circuits 10. Since initialization, threshold detection, and light emission are performed to all of the pixel circuits 10 at the same timing, the configurations of the control circuit 3 and the power supply circuit 4 can be simplified. On the other hand, in the case of q≥2, the initialization period, the threshold detection period, and the light emission period vary among the groups of the pixel circuits 10. Since initialization, threshold detection, and light emission are performed to each group of the pixel circuits 10 at a different timing, the data writing period and the light emission period can be made longer than those in the case of q=1. The various modifications can be similarly applied not only to the first embodiment but also to the second and third embodiments to be described below.

Second Embodiment

Figure 12:
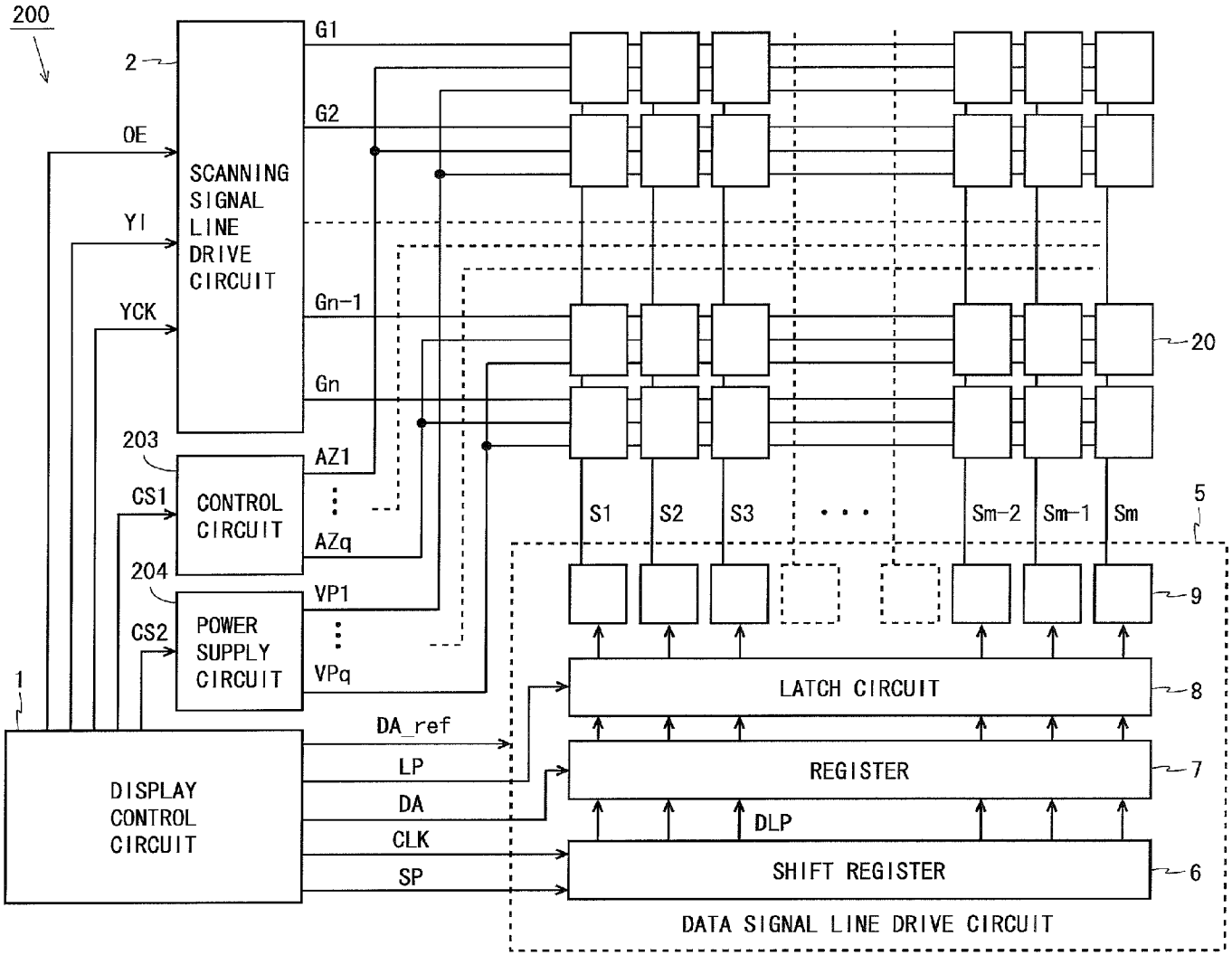
FIG. 12 is a block diagram illustrating a configuration of a display device according to a second embodiment of the present invention.

FIG. 12 is a block diagram illustrating a configuration of a display device according to a second embodiment of the present invention. A display device 200 illustrated in FIG. 12 is an organic EL display having the display control circuit 1, the scanning signal line drive circuit 2, a control circuit 203, a power supply circuit 204, the data signal line drive circuit 5, and (m×n) pieces of pixel circuits 20. In the following embodiments, the same reference numerals are designated to the same components as those of the foregoing embodiment and their description will be omitted. Hereinafter, the points different from the display device 100 of the first embodiment will be described.

The display device 200 is provided with q pieces of control lines AZ1 to AZq, as control lines. The pixel circuits 20 in each row are connected to one of the control lines AZ1 to AZq and one of the power supply lines VP1 to VPq. To the pixel circuit 20, the common potential Vcom is supplied by using a not-illustrated conductive member (electrode) and a predetermined potential V0 is supplied by using not-illustrated power supply line.

The control circuit 203 selectively applies the high-level potential and the low-level potential to the control lines AZ1 to AZq based on the control signal CS1. The power supply circuit 204 selectively applies three kinds of potentials to the power supply lines VP1 to VPq based on the control signal CS2. More specifically, the power supply circuit 204 selectively applies a potential to each of the power supply lines VP1 to VPq, the potential being selected from among a potential VP_H higher than the common potential Vcom, the potential VP_C substantially equal to Vcom, and the potential VP_L lower than Vcom.

Figure 13:
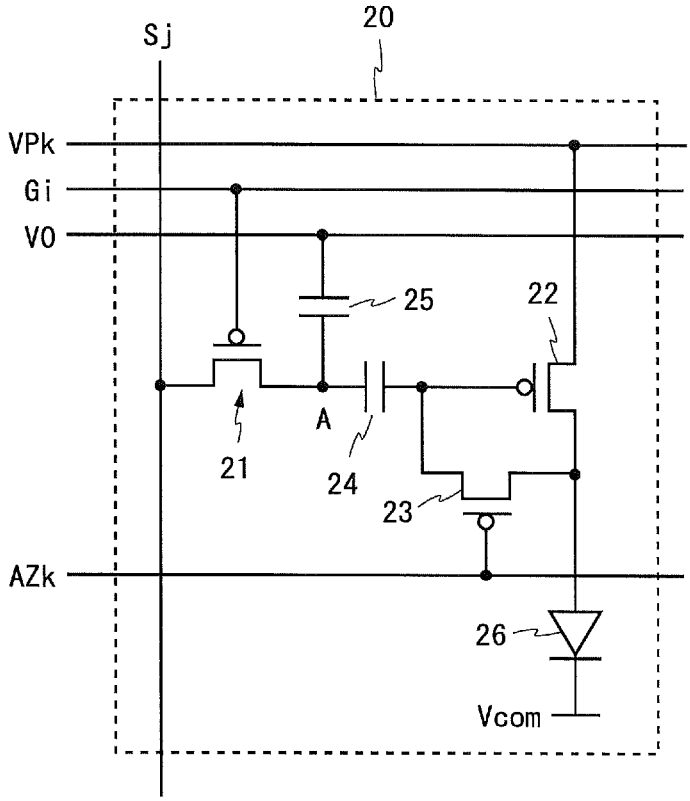
FIG. 13 is a circuit diagram of a pixel circuit included in the display device illustrated in FIG. 12.

FIG. 13 is a circuit diagram of the pixel circuit 20. As illustrated in FIG. 13, the pixel circuit 20 includes TFTs 21 to 23, capacitors 24 and 25, and an organic EL element 26. Each of the TFTs 21 to 23 is a P-channel-type transistor. The pixel circuit 20 is connected to the scanning signal line Gi, the data signal line Sj, the control line AZk, the power supply line VPk, a power supply line having the potential V0, and an electrode having the common potential Vcom.

One of conduction terminals of the TFT 21 is connected to the data signal line Sj, and the other conduction terminal is connected to one of terminals of the capacitor 24 (hereinbelow, called node A). The other terminal of the capacitor 24 is connected to the gate terminal of the TFT 22. The source terminal of the TFT 22 is connected to the power supply line VPk, and the drain terminal is connected to the anode terminal of the organic EL element 26. The cathode terminal of the organic EL element 26 is connected to the electrode having the common potential Vcom. The TFT 23 is provided between the gate terminal and the drain terminal (the conduction terminal on the organic EL element 26 side) of the TFT 22. One of electrodes of the capacitor 25 is connected to the line having the potential V0, and the other electrode is connected to the node A. The gate terminal of the TFT 21 is connected to the scanning signal line Gi, and the gate terminal of the TFT 23 is connected to the control line AZk. The TFTs 21 to 23 function as a write control transistor, a drive transistor, and a threshold detection transistor, respectively, and the organic EL element 26 functions as a light emitting element.

Hereinbelow, the case where q=1 will be described. A connection form of the control line and the power supply line in the case of q=1 is similar to that of FIG. 3. By reading the control circuit 3, the power supply circuit 4, and the control line E1 in FIG. 3 as the control circuit 203, the power supply circuit 204, and the control line AZ1, respectively, the connection form of the present embodiment is obtained. The operations of the pixel circuit 20 in each row in one frame period in the display device 200 are the same as those of the first embodiment (refer to FIG. 4). In the display device 200, however, node initialization and anode initialization are performed in the initialization period.

Figure 14:
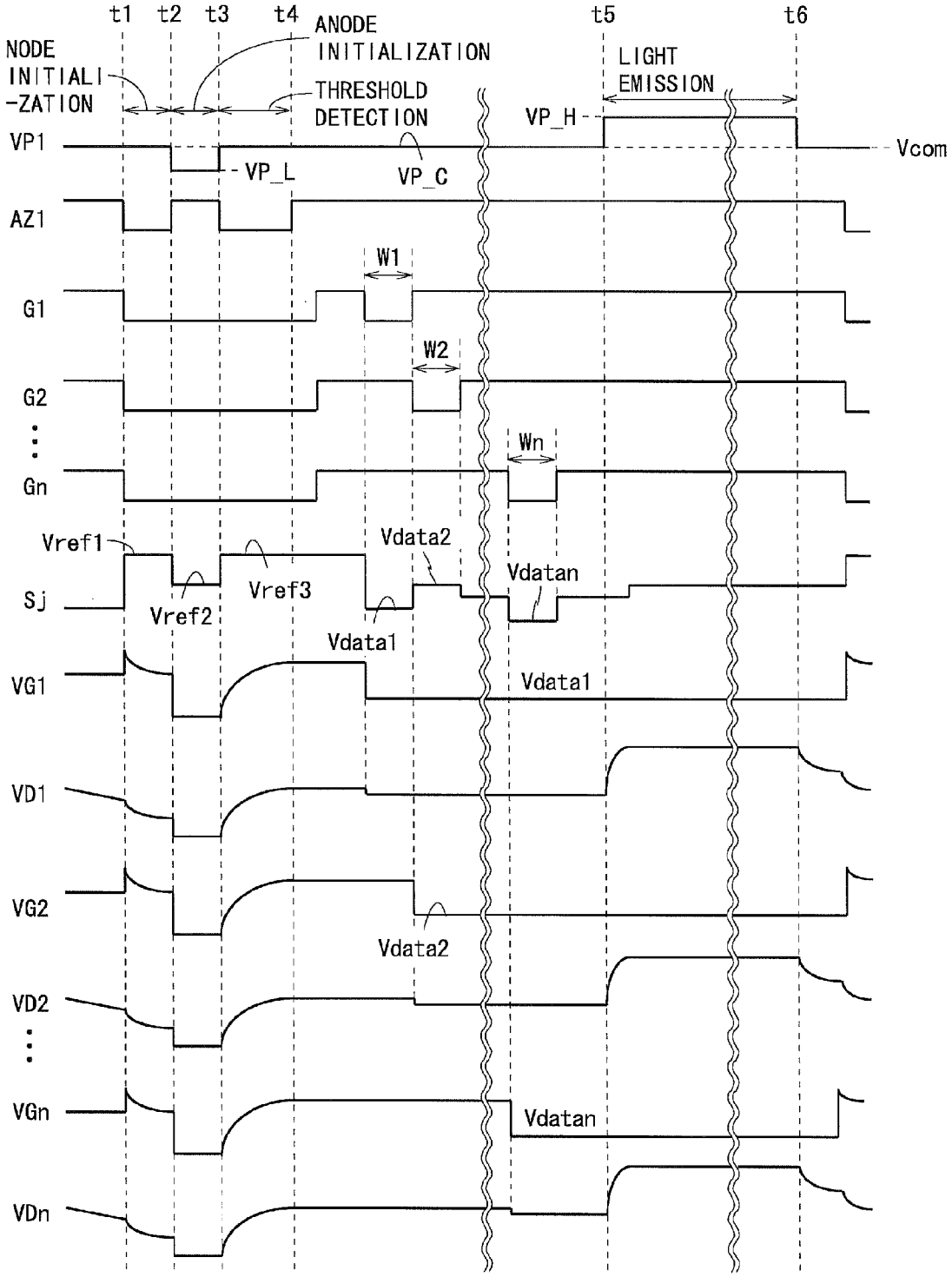
FIG. 14 is a timing chart of the display device illustrated in FIG. 12.

FIG. 14 is a timing chart illustrating the operations of the pixel circuits 20. The meanings of Wi and VGi illustrated in FIG. 14 are similar to those in the first embodiment. VDi represents the drain potential of the TFT 22 (that is, the anode potential of the organic EL element 26) in the pixel circuit 20 in the i-th row.

Hereinafter, with reference to FIG. 14, the operations of the pixel circuit 20 connected to the scanning signal line Gi, the data signal line Sj, the control line AZ1, and the power supply line VP1 will be described. Before time t1, the potentials of the scanning signal line Gi and the control line AZ1 are at the high level, and the potential of the power supply line VP1 is VP_C which is substantially equal to the common potential Vcom.

(a) Node Initialization

At time t1, the potentials of the scanning signal line Gi and the control line AZ1 change to the low level. With the change, the TFTs 21 and 23 change to an on state. Between time t1 and time t2, the potential of the power supply line VP1 remains VP_C which is substantially equal to the common potential Vcom, and the potential of the data signal line Sj becomes Vref1. Consequently, the potential of the node A becomes Vref1. The potential Vref1 is determined such that the TFT 21 enters an on state. At this time, the organic EL element 26 does not emit light, so that the anode potential of the organic EL element 26 and the gate potential of the TFT 22 become substantially equal to the common potential Vcom.

(b) Anode Initialization

At time t2, the potential of the control line AZ1 changes to the high level. With this change, the TFT 23 changes to an off state. Between time t2 and time t3, the potential of the power supply line VP1 becomes VP_L which is lower than the common potential Vcom, and the potential of the data signal line Sj becomes Vref2 which is lower than Vref1. At this time, the TFT 21 is in the on state and the TFT 23 is in the off state. Consequently, when the potential of the data signal line Sj falls by (Vref1−Vref2), the gate potential of the TFT 22 falls by the same amount. Accordingly, the TFT 22 enters an on state, and electric charge stored at the anode terminal of the organic EL element 26 is discharged toward the power supply line VP1. As a result, the anode potential of the organic EL element 26 becomes VP_L.

(c) Threshold Detection

At time t3, the potential of the control line AZ1 changes to the low level. With the change, the TFT 23 changes to the on state. At time t3, the potential of the power supply line VP1 changes to VP_C which is substantially equal to the common potential Vcom. At this time, current flows from the power supply line VP1 into the gate terminal of the TFT 22 through the TFTs 22 and 23, and the gate potential of the TFT 22 rises. When the threshold voltage of the TFT 22 is assumed to be Vth, the gate potential of the TFT 22 rises to (VP_C+Vth). At time t3, the potential of the data signal line Sj changes to Vref3. At this time, since the TFT 21 remains in the on state, the potential of the node A changes to Vref3. On the other hand, the TFT 23 is in the on state at this time, and the organic EL element 26 has a capacitance value sufficiently larger than that of the capacitor 24. Consequently, even when the potential of the node A changes, the gate potential of the TFT 22 is hardly influenced.

(d) Data Standby

At time t4, the potential of the control line AZ1 changes to the high level. With the change, the TFT 23 changes to the off state. After that, the potential of the scanning signal line Gi changes to the high level and, accordingly, the TFT 21 changes to an off state. Hereinafter, the gate potential of the TFT 22 is maintained at (VP_C+Vth) by the action of the capacitors 24 and 25.

Ideally, in the data standby period, the current does not flow from the anode terminal of the organic EL element 26 to either of the organic EL element 26 side or the power supply line VP1 side, and the anode potential of the organic EL element 26 maintains at (VP_C+Vth). However, without any special contrivance, an unignorable degree of leak current flows through the TFTs 22 and 23 in the data standby period, and the anode potential of the organic EL element 26 fluctuates.

Therefore, for a period from completion of the threshold detection to start of light emission, the display device 200 according to the embodiment controls the TFT 23 to the off state and also sets the potential of the power supply line VP1 to VP_C which is substantially equal to the common potential Vcom. With this, in the standby period, leak current can be prevented from flowing from the anode terminal of the organic EL element 26 to the power supply line VP1, and the anode potential of the organic EL element 26 can be maintained constant.

(e) Data Writing

The data writing period Wi of the pixel circuits 20 in the i-th row is set in a period from time t4 to time t5. In the data writing period Wi, the potential of the scanning signal line Gi becomes the low level, and the potential of the data signal line Sj becomes a data potential Vdata. At this time, the TFT 21 is in the on state, so that the potential of the node A changes to Vdata. At this time, the TFT 23 is in the off state, so that the gate potential of the TFT 22 changes by the same amount as the potential of the node A to become (VP_C+Vth+Vdata−Vref3).

(f) Light Emission Standby

In the light emission standby period, like the data standby period, the potentials of the scanning signal line Gi and the control line AZ1 become the high level, and the potential of the power supply line VP1 becomes VP_C which is substantially equal to the common potential Vcom. In the light emission standby period, the gate potential of the TFT 22 is maintained at (VP_C+Vth+Vdata−Vref3) by the action of the capacitors 24 and 25.

(g) Light Emission

At time t5, the potential of the power supply line VP1 changes to VP_H which is higher than the common potential Vcom. Consequently, a voltage higher than a light emission threshold voltage is applied to the organic EL element 26, and the organic EL element 26 emits light. The potential VP_H is determined such that the TFT 22 operates in a saturation region in the light emission period. Therefore, the current I flowing through the organic EL element 26 in the light emission period is given by the above-described equation (4) when the channel length modulation effect is ignored.

Also in the light emission period, the gate potential of the TFT 22 is maintained to remain at (VP_C+Vth+Vdata−

Vref3). Therefore, the gate-source voltage Vgs of the TFT 22 in the light emission period is given by the following equation (6).

$$Vgs = VP_C + Vth + V\text{data} - V\text{ref}3 - VP_H \quad (6)$$

From the equations (4) and (6), the following equation (7) is derived.

$$I = 1/2 \cdot W/L \cdot \mu \cdot Cox \times (\text{VP_C} + Vdata - Vref3 - \text{VP_H})^2 \quad (7)$$

Although the current I in the equation (7) changes depending on the data potential Vdata, it does not depend on the threshold voltage Vth of the TFT 22. Therefore, even in the case where variation occurs in the threshold voltage Vth or in the case where the threshold voltage Vth changes with time, by making current which does not depend on the threshold voltage Vth flow through the organic EL element 26, the organic EL element 26 can be made to emit light with desired brightness.

(h) Turn Off

At time t6, the potential of the power supply line VP1 changes to VP_C which is substantially equal to the common potential Vcom. Consequently, after time t6, the anode potential of the organic EL element 26 falls. After a while from time t6, the anode potential of the organic EL element 26 becomes sufficiently low, and the organic EL element 26 turns off.

As descried above, in the display device 200 according to the embodiment, the pixel circuit 20 includes a light emitting element (organic EL element 26) provided on a current path connecting the power supply line VPk and a conductive member (electrode) to which the common potential Vcom is applied, and having one end connected to the conduction member; a drive transistor (TFT 22) provided on the current path, and having one of conduction terminals connected to the other end of the light emitting element; the first capacitor 24 having one end connected to a control terminal of the drive transistor; a write control transistor (TFT 21) provided between the other end of the first capacitor and the data signal line Sj, and having a control terminal connected to the scanning signal line Gi; a threshold detection transistor (TFT 23) provided between the control terminal and the conduction terminal on the light emitting element side of the drive transistor (the drain terminal of the TFT 22), and having a control terminal connected to the control line AZk; and the second capacitor 25 provided between the other end of the first capacitor and the power supply line having the predetermined potential V0. The one end of the light emitting element (the cathode terminal of the organic EL element 26) is connected to the conductive member to which the common potential Vcom is fixedly applied, and the other conduction terminal of the drive transistor is connected to the power supply line VPk.

The drive circuit (a circuit configured by the scanning signal line drive circuit 2, the control circuit 203, and the data signal line drive circuit 5) and the power supply circuit 204 simultaneously perform initialization to pixel circuits 20 in a plurality of rows, simultaneously perform threshold detection to the pixel circuits 20 in the plurality of rows, sequentially write data to the pixel circuits 20 row by row, and perform a control to make light emitting elements included in the pixel circuits 20 in the plurality of rows emit light in the same period. The power supply circuit 204 applies the potential VP_C substantially equal to the common potential Vcom to the power supply line VPk connected to the pixel circuit 20 in a period from completion of detecting threshold of the pixel circuit 20 to start of light emission.

In the display device 200 according to the embodiment, with respect to the pixel circuit 20 including three transistors, two capacitors, and a light emitting element, by applying the potential VP_C which is substantially equal to the common potential Vcom to the power supply line VPk in the period from completion of threshold detection to start of light emission, fluctuation in the node potential in the pixel circuit 20 in the standby period can be prevented, and fluctuation in brightness of a display screen can be prevented.

Third Embodiment

Figure 15:
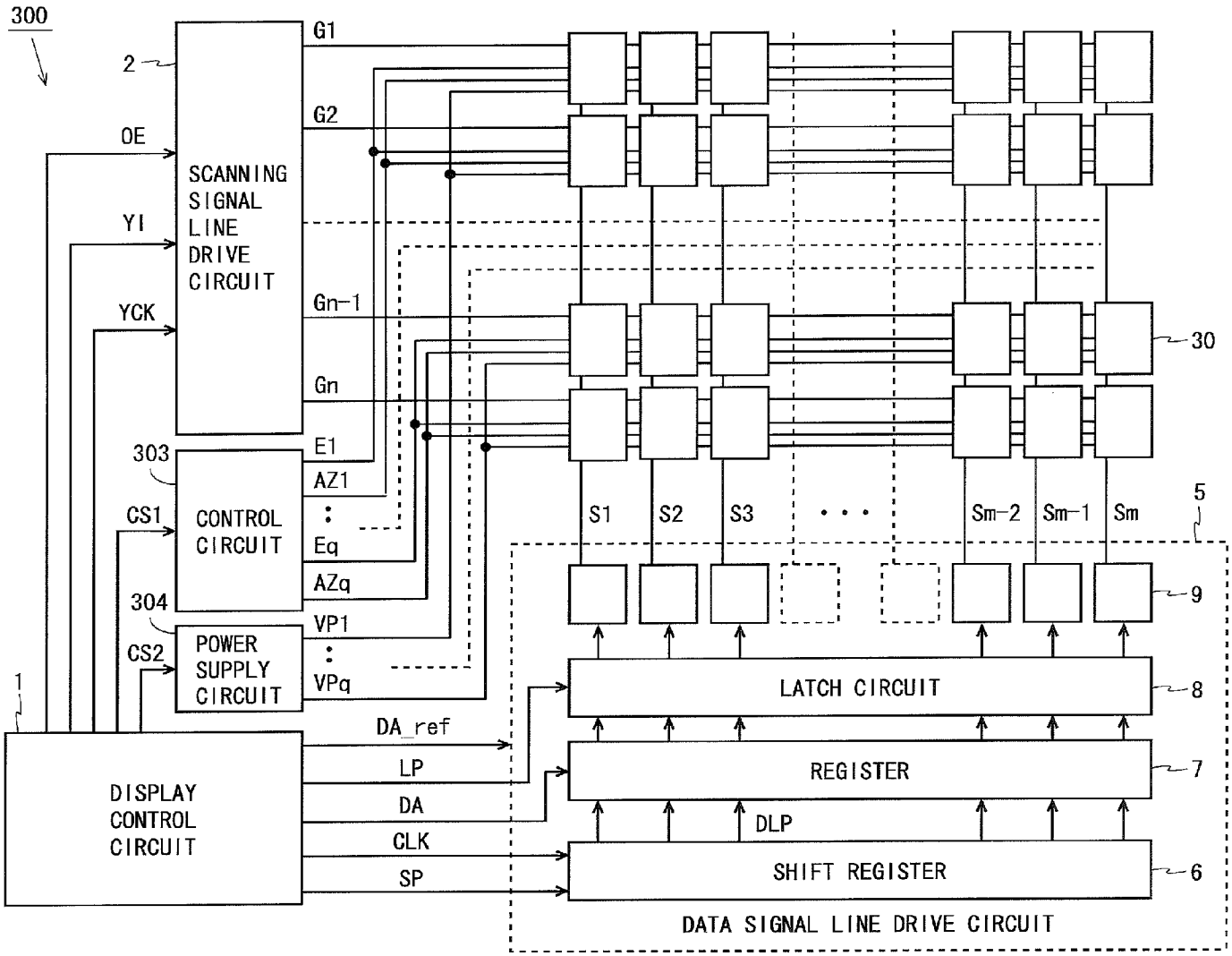
FIG. 15 is a block diagram illustrating a configuration of a display device according to a third embodiment of the present invention.

FIG. 15 is a block diagram illustrating a configuration of a display device according to a third embodiment of the present invention. A display device 300 illustrated in FIG. 15 is an organic EL display having the display control circuit 1, the scanning signal line drive circuit 2, a control circuit 303, a power supply circuit 304, the data signal line drive circuit 5, and (m×n) pieces of pixel circuits 30. Hereinafter, the points different from the display device 100 of the first embodiment will be described.

The display device 300 is provided with, as control lines, q pieces of control lines E1 to Eq and q pieces of control lines AZ1 to AZq. The pixel circuits 30 in each row are connected to one of the control lines E1 to Eq, one of the control lines AZ1 to AZq and one of the power supply lines VP1 to VPq. To the pixel circuit 30, the common potential Vcom is supplied by using a not-illustrated conductive member (electrode).

The control circuit 303 selectively applies the high-level potential and the low-level potential to the control lines E1 to Eq and the control lines AZ1 to AZq based on the control signal CS1. The power supply circuit 304 selectively applies three kinds of potentials to the power supply lines VP1 to VPq based on the control signal CS2. More specifically, the power supply circuit 304 selectively applies a potential to each of the power supply lines VP1 to VPq, the potential being selected from among the potential VP_H higher than the common potential Vcom, the potential VP_C substantially equal to Vcom, and the potential VP_L lower than Vcom.

Figure 16:
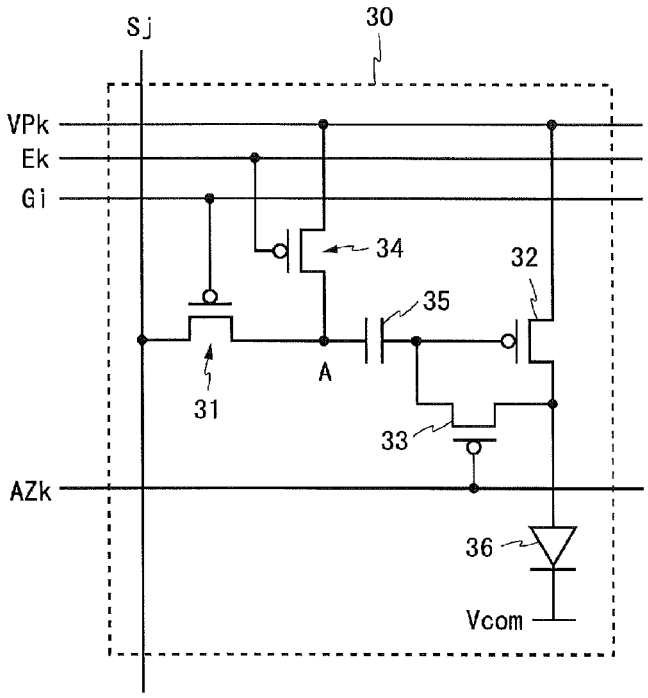
FIG. 16 is a circuit diagram of a pixel circuit included in the display device illustrated in FIG. 15.

FIG. 16 is a circuit diagram of the pixel circuit 30. As illustrated in FIG. 16, the pixel circuit 30 includes TFTs 31 to 34, a capacitor 35, and an organic EL element 36. Each of the TFTs 31 to 34 is a P-channel-type transistor. The pixel circuit 30 is connected to the scanning signal line Gi, the data signal line Sj, the control lines Ek and AZk, the power supply line VPk, and an electrode having the common potential Vcom.

One of conduction terminals of the TFT 31 is connected to the data signal line Sj, and the other conduction terminal is connected to one of terminals of the capacitor 35 (hereinbelow, called node A). The other terminal of the capacitor 35 is connected to the gate terminal of the TFT 32. The source terminal of the TFT 32 is connected to the power supply line VPk, and the drain terminal is connected to the anode terminal of the organic EL element 36. The cathode terminal of the organic EL element 36 is connected to the electrode having the common potential Vcom. The TFT 33 is provided between the gate terminal and the drain terminal (the conduction terminal on the organic EL element 36 side) of the TFT 32. The source terminal of the TFT 34 is connected to the power supply line VPk, and the drain terminal is connected to the node A. The gate terminal of the TFT 31 is connected to the scanning signal line Gi, the gate terminal of the TFT 33 is connected to the control line AZk, and the gate terminal of the TFT 34 is connected to the control line Ek. The TFTs 31 to 34 function as a write control transistor, a drive transistor, a threshold detection transistor, and a power supply connection transistor, respectively, and the organic EL element 36 functions as a light emitting element.

Figure 17:
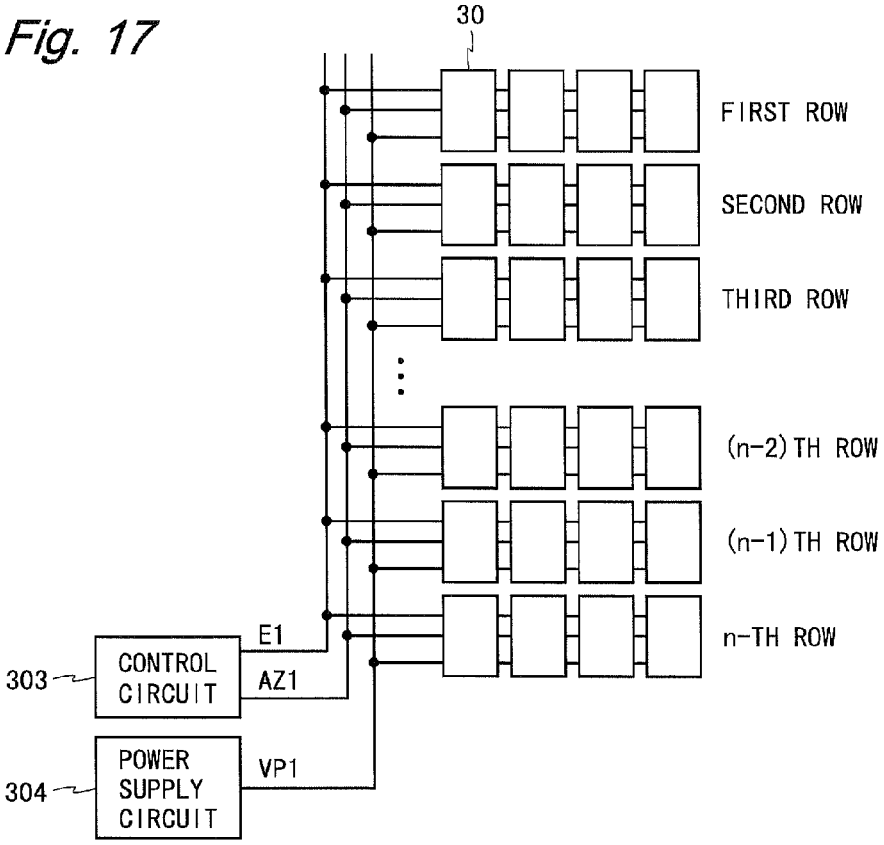
FIG. 17 is a diagram illustrating a connection form of control lines and a power supply line of the display device illustrated in FIG. 15.

Hereinbelow, the case where q=1 will be described. FIG. 17 is a diagram illustrating a connection form of the control lines and the power supply line. In this case, all of the pixel circuits 30 are connected to the control lines E1 and AZ1 and the power supply line VP1. The operations of the pixel circuits 30 in each row in one frame period in the display device 300 are the same as those of the first embodiment (refer to FIG. 4). In the display device 300, however, node initialization and anode initialization are performed in the initialization period.

Figure 18:
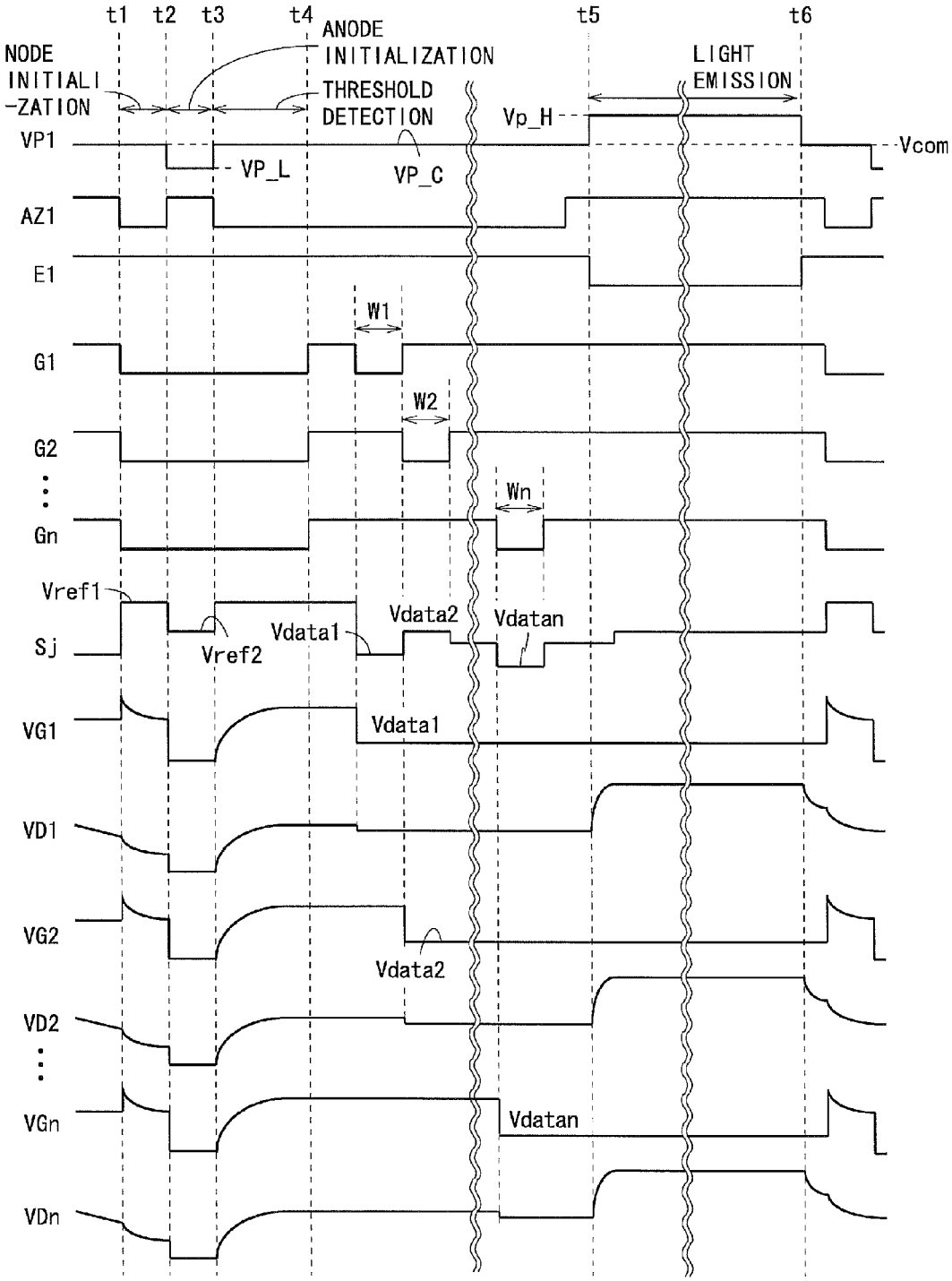
FIG. 18 is a timing chart of the display device illustrated in FIG. 15.
Figure 19:
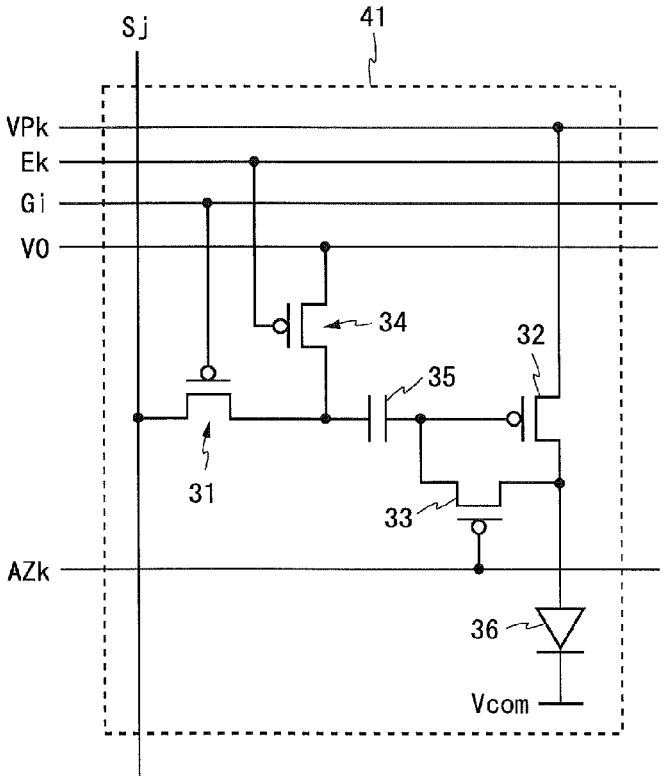
FIG. 19 is a circuit diagram of a pixel circuit included in a display device according to a first modification.
Figure 20:
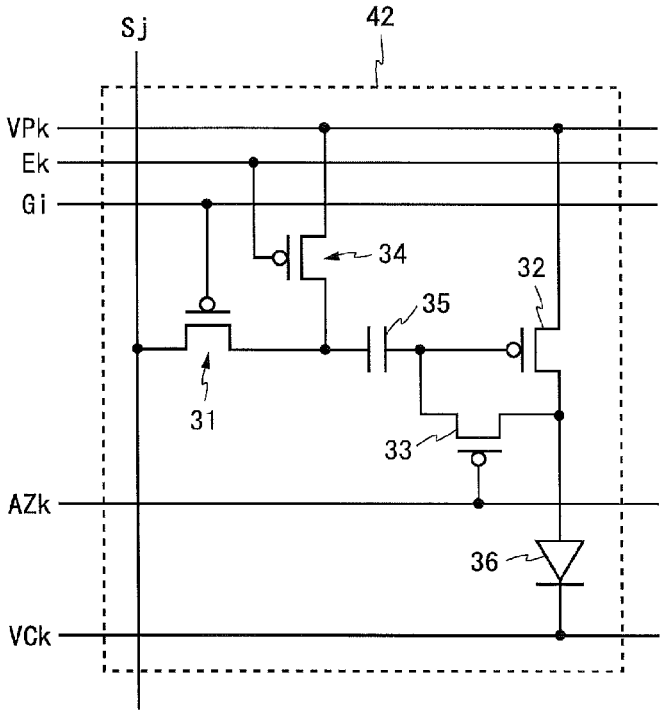
FIG. 20 is a circuit diagram of a pixel circuit included in a display device according to a second modification.
Figure 21:
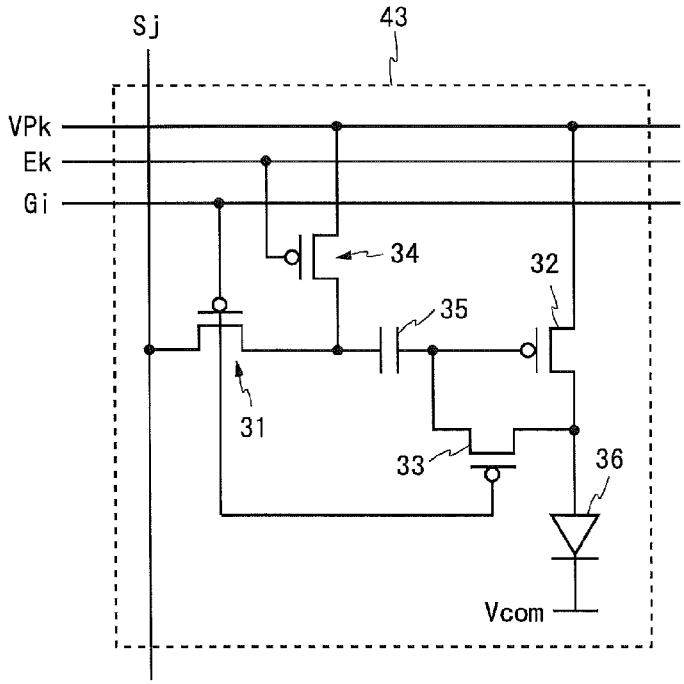
FIG. 21 is a circuit diagram of a pixel circuit included in a display device according to a third modification.

FIG. 18 is a timing chart illustrating the operations of the pixel circuits 30. The meanings of Wi and VGi illustrated in FIG. 18 are similar to those in the first embodiment, and the meaning of VDi illustrated in FIG. 18 is similar to that of the second embodiment.

Hereinafter, with reference to FIG. 18, the operations of the pixel circuit 30 connected to the scanning signal line Gi, the data signal line Sj, the control lines E1 and AZ1, and the power supply line VP1 will be described. Before time t1, the potentials of the scanning signal line Gi and the control lines E1 and AZ1 are at the high level, and the potential of the power supply line VP1 is VP_C which is substantially equal to the common potential Vcom.

(a) Node Initialization

At time t1, the potentials of the scanning signal line Gi and the control line AZ1 change to the low level. With the change, the TFTs 31 and 33 change to an on state. Between time t1 and time t2, the potential of the power supply line VP1 remains VP_C which is substantially equal to the common potential Vcom, and the potential of the data signal line Sj becomes Vref1. Consequently, the potential of the node A becomes Vref1. The potential Vref1 is determined such that the TFT 31 enters an on state. At this time, the organic EL element 36 does not emit light, so that the anode potential of the organic EL element 36 and the gate potential of the TFT 32 become substantially equal to the common potential Vcom.

(b) Anode Initialization

At time t2, the potential of the control line AZ1 changes to the high level. With the change, the TFT 33 changes to an off state. Between time t2 and time t3, the potential of the power supply line VP1 becomes VP_L which is lower than the common potential Vcom, and the potential of the data signal line Sj becomes Vref2 which is lower than Vref1. At this time, the TFT 31 is in the on state and the TFTs 33 and 34 are in an off state. Consequently, when the potential of the data signal line Sj falls by (Vref1−Vref2), the gate potential of the TFT 32 falls by the same amount. Accordingly, the TFT 32 enters an on state, and electric charge stored at the anode terminal of the organic EL element 36 is discharged toward the power supply line VP1. As a result, the anode potential of the organic EL element 36 becomes VP_L.

(c) Threshold Detection

At time t3, the potential of the control line AZ1 changes to the low level. With the change, the TFT 33 changes to the on state. At time t3, the potential of the power supply line VP1 changes to VP_C which is substantially equal to the common potential Vcom. At this time, current flows from the power supply line VP1 into the gate terminal of the TFT 32 through the TFTs 32 and 33, and the gate potential of the TFT 32 rises. When the threshold voltage of the TFT 32 is assumed to be Vth, the gate potential of the TFT 32 rises to (VP_C+Vth). At time t3, the potential of the data signal line Sj changes to Vref1. At this time, since the TFT 31 remains in the on state, the potential of the node A changes to Vref1. On the other hand, the TFT 33 is in the on state at this time, and the organic EL element 36 has a capacitance value sufficiently larger than that of the capacitor 35. Consequently, even when the potential of the node A changes, the gate potential of the TFT 32 is hardly influenced.

(d) Data Standby

At time t4, the potential of the scanning signal line Gi changes to the high level. With the change, the TFT 31 changes to an off state. At this time point, the anode potential of the organic EL element 36 and the gate potential of the TFT 32 are (VP_C+Vth).

Ideally, in the data standby period, the current does not flow from the anode terminal of the organic EL element 36 to either of the organic EL element 36 side or the power supply line VP1 side, and the anode potential of the organic EL element 36 maintains at (VP_C+Vth). However, without any special contrivance, an unignorable degree of leak current flows through the TFT 32 in the data standby period, and the anode potential of the organic EL element 36 fluctuates.

Therefore, for a period from completion of the threshold detection to start of light emission, the display device 300 according to the embodiment sets the potential of the power supply line VP1 to VP_C which is substantially equal to the common potential Vcom. With this, in the standby period, leak current can be prevented from flowing from the anode terminal of the organic EL element 36 to the power supply line VP1, and the anode potential of the organic EL element 36 can be maintained constant.

(e) Data Writing

The data writing period Wi of the pixel circuits 30 in the i-th row is set in a period from time t4 to time t5. In the data writing period Wi, the potential of the scanning signal line Gi becomes the low level, and the potential of the data signal line Sj becomes a data potential Vdata. At this time, the TFT 31 is in the on state, so that the potential of the node A changes to Vdata. The TFT 33 is in the on state at this time, and the organic EL element 36 has a capacitance value sufficiently larger than that of the capacitor 35. Consequently, even when the potential of the node A changes, the gate potential of the TFT 32 is hardly influenced.

(f) Light Emission Standby

In the light emission standby period, like the data standby period, the scanning signal line Gi becomes the high level, and the potential of the power supply line VP1 becomes VP_C which is substantially equal to the common potential Vcom. At this time, the potential of the node A is Vdata, and the gate potential of the TFT 32 is (VP_C+Vth).

(g) Light Emission

Before time t5, the potential of the control line AZ1 changes to the high level. With the change, the TFT 33 changes to the off state. At time t5, the potential of the control line E1 changes to the low level. With the change, the TFT 34 changes to an on state. At time t5, the potential of the power supply line VP1 changes to VP_H which is higher than the common potential Vcom. Consequently, the potential of the node A changes from Vdata to VP_H. A voltage higher than a light emission threshold voltage is applied to the organic EL element 36, and the organic EL element 36 emits light. The potential VP_H is determined such that the TFT 32 operates in a saturation region in the light emission period. Therefore, the current I flowing through the organic EL element 36 in the light emission period is given by the above-described equation (4) when the channel length modulation effect is ignored.

Since the TFT 33 is in the off state in the light emission period, when the potential of the node A changes from Vdata to VP_H, the gate potential of the TFT 32 changes by the same amount and becomes (VP_C+Vth+VP_H−Vdata). Therefore, the gate-source voltage Vgs of the TFT 32 in the light emission period is given by the following equation (8).

$$Vgs=VP_C+Vth-Vdata \quad (8)$$

From the equations (4) and (8), the following equation (9) is derived.

$$I=\frac{1}{2}\sim W/L\cdot\mu\cdot Cox(VP_C\cdot Vdata)^2 \quad (9)$$

Although the current I in the equation (9) changes depending on the data potential Vdata, it does not depend on the threshold voltage Vth of the TFT 32. Therefore, even in the case where variation occurs in the threshold voltage Vth or in the case where the threshold voltage Vth changes with time, by making current which does not depend on the threshold voltage Vth flow through the organic EL element 36, the organic EL element 36 can be made to emit light with desired brightness.

(h) Turn Off

At time t6, the potential of the control line E1 changes to the high level. With the change, the TFT 34 changes to an off state. At time t6, the potential of the power supply line VP1 changes to VP_C. Consequently, after time t6, the anode potential of the organic EL element 36 falls. After a while from time t6, the voltage applied to the organic EL element 36 becomes sufficiently low, and the organic EL element 36 turns off.

As descried above, in the display device 300 according to the embodiment, the pixel circuit 30 includes a light emitting element (organic EL element 36) provided on a current path connecting the power supply line VPk and a conductive member (electrode) to which the common potential Vcom is applied, and having one end connected to the conductive member; a drive transistor (TFT 32) provided on the current path, and having one of conduction terminals connected to the other end of the light emitting element; the capacitor 35 having one end connected to a control terminal of the drive transistor; a write control transistor (TFT 31) provided between the other end of the capacitor and the data signal line Sj, and having a control terminal connected to the scanning signal line Gi; a threshold detection transistor (TFT 33) provided between the control terminal and the conduction terminal on the light emitting element side of the drive transistor (the drain terminal of the TFT 32), and having a control terminal connected to the control line AZk; and a power supply connection transistor (TFT 34) provided between the other end of the capacitor and the power supply line VPk. The one end of the light emitting element (the cathode terminal of the organic EL element 36) is connected to the conductive member to which the common potential Vcom is fixedly applied, and the other conduction terminal of the drive transistor is connected to the power supply line VPk.

The drive circuit (a circuit configured by the scanning signal line drive circuit 2, the control circuit 303, and the data signal line drive circuit 5) and the power supply circuit 304 simultaneously perform initialization to pixel circuits 30 in a plurality of rows, simultaneously perform threshold detection to the pixel circuits 30 in the plurality of rows, sequentially write data to the pixel circuits 30 row by row, and perform a control to make light emitting elements included in the pixel circuits 30 in the plurality of rows emit light in the same period. The power supply circuit 304 selectively applies three kinds of potentials to the power supply line VPk. The power supply circuit 304 applies the potential VP_C which is substantially equal to the common potential Vcom to the power supply line VPk connected to the pixel circuit 30 in the period from completion of detecting threshold to start of light emission of the pixel circuit 30.

In the display device 300 according to the embodiment, with respect to the pixel circuit 30 including four transistors, one capacitor, and a light emitting element, by applying the potential VP_C which is substantially equal to the common potential Vcom to the power supply line VPk in the period from completion of threshold detection to start of light emission, fluctuation in the node potential in the pixel circuit 30 in the standby period can be prevented, and fluctuation in brightness of a display screen can be prevented.

Figure 22:
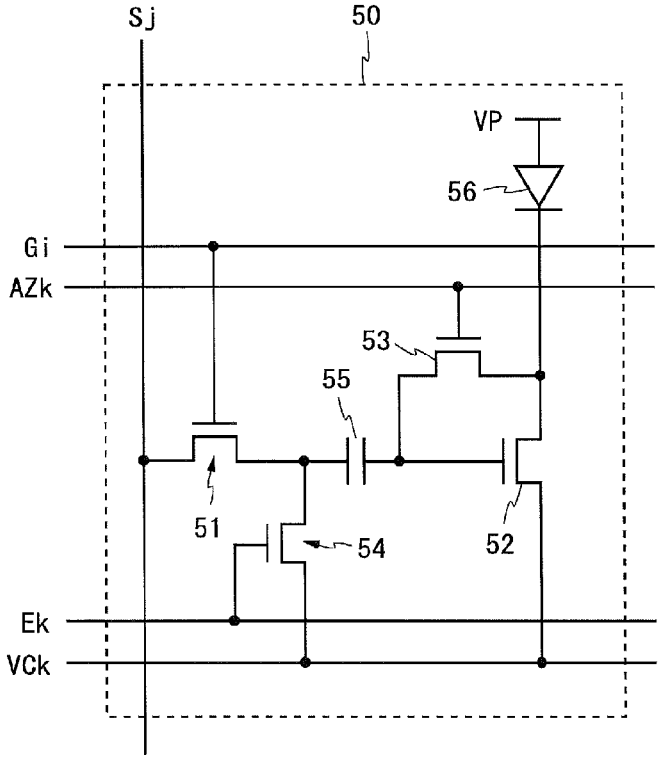
FIG. 22 is a circuit diagram of a pixel circuit included in a display device according to a fourth modification.
Figure 23:
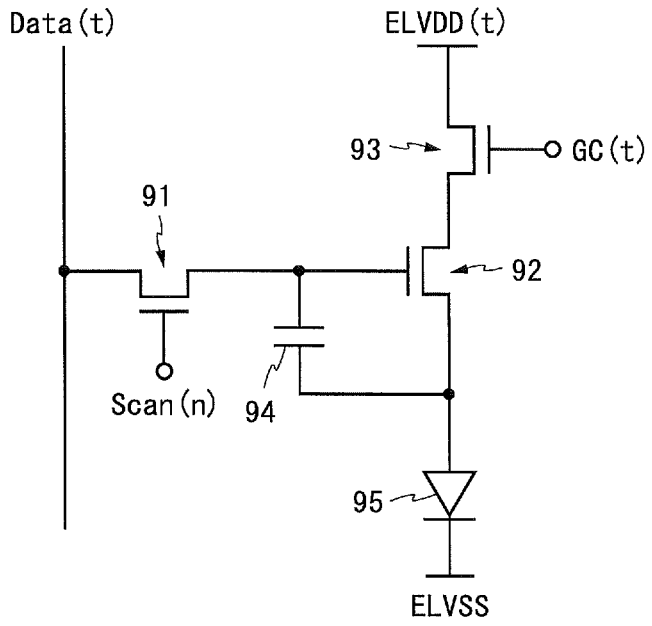
FIG. 23 is a circuit diagram of a pixel circuit included in a conventional display device.

As a modification of the display device 300 according to the embodiment, display devices having one of pixel circuits illustrated in FIGS. 19 to 22 can be configured. In a pixel circuit 41 illustrated in FIG. 19, the source terminal of the TFT 34 is connected to a power supply line having an adjustable potential V0. In a pixel circuit 42 illustrated in FIG. 20, the cathode terminal of the organic EL element 36 is connected to a power supply line VCk (one of power supply lines VC1 to VCq each connected to a plurality of pixel circuits). In this case, the power supply circuit selectively applies two kinds of potentials to the power supply lines VPk and VCk respectively. In a pixel circuit 43 illustrated in FIG. 21, the gate terminal of the TFT 33 is connected to the scanning signal line Gi. A pixel circuit 50 illustrated in FIG. 22 is configured as a circuit corresponding to the pixel circuit 30 according to the third embodiment by using N-channel-type transistors. The pixel circuit 50 includes TFTs 51 to 54, a capacitor 55, and an organic EL element 56. In the display device having the pixel circuit 41, 43, or 50, by applying the potential VP_C substantially equal to the common potential Vcom to the power supply line VPk in the period from completion of threshold detection to start of light emission, fluctuation in the node potential in the pixel circuit in the standby period can be prevented, and fluctuation in brightness of a display screen can be prevented. In the display device having the pixel circuit 42, by applying the same potential to the power supply lines VPk and VCk in the period from completion of threshold detection to start of light emission, a similar effect can be obtained.

In the display device having the pixel circuit 30, 41, or 50, by using one kind of power supply line(s), the layout area of the power supply line can be reduced. In the display device having the pixel circuit 42, by using a power supply circuit selectively applying two kinds of potentials, the configuration of the power supply circuit can be simplified. In the display device having the pixel circuit 43, by using one kind of control line(s) and one kind of power supply line(s), the layout areas of the control line and the power supply line can be reduced, and the configuration of the drive circuit can be simplified.

As described above, according to the present invention, in the display device in which initialization is simultaneously performed to the pixel circuits in the plurality of rows, threshold detection is simultaneously performed to the pixel circuits in the plurality of rows, data is sequentially written to the pixel circuits row by row, and light emitting elements included in the pixel circuits in the plurality of rows are made to emit light in the same period, by applying a potential which is substantially equal to the common potential to the power supply lines connected to the pixel circuit in the period from completion of threshold detection to start of light emission of the pixel circuits, fluctuation in the node potential in the pixel circuit can be prevented in the standby period, and fluctuation in brightness of a display screen can be prevented.

INDUSTRIAL APPLICABILITY

The display device of the present invention has a characteristic of preventing fluctuation in a node potential in a pixel circuit in a standby period, and also preventing fluctuation in brightness of a display screen. Consequently, the display device can be used as a current drive type display device such as an organic EL display.

DESCRIPTION OF REFERENCE CHARACTERS

1: DISPLAY CONTROL CIRCUIT
2: SCANNING SIGNAL LINE DRIVE CIRCUIT
3, 203, 303: CONTROL CIRCUIT
4, 204, 304: POWER SUPPLY CIRCUIT
5: DATA SIGNAL LINE DRIVE CIRCUIT
6: SHIFT REGISTER
7: REGISTER
8: LATCH CIRCUIT
9: OUTPUT BUFFER
10, 20, 30, 41 to 43, 50: PIXEL CIRCUIT
11, 21, 31, 51: TFT (WRITE CONTROL TRANSISTOR)
12, 22, 32, 52: TFT (DRIVE TRANSISTOR)
13: TFT (LIGHT EMISSION CONTROL TRANSISTOR)
14, 24, 25, 35, 55: CAPACITOR
15, 26, 36, 56: ORGANIC EL ELEMENT (LIGHT EMITTING ELEMENT)
23, 33, 53: TFT (THRESHOLD DETECTION TRANSISTOR)
34, 54: TFT (POWER SUPPLY CONNECTION TRANSISTOR)
100, 200, 300: DISPLAY DEVICE

The invention claimed is:

1. A current drive type display device, comprising:
a plurality of pixel circuits disposed in a row direction and a column direction;
a plurality of scanning signal lines each connected to the pixel circuits in the same row;
a plurality of data signal lines each connected to the pixel circuits in the same column;
one or more control lines each connected to the pixel circuits in a plurality of rows;
one or more power supply lines each connected to the pixel circuits in the plurality of rows;
a drive circuit configured to drive the scanning signal lines, the data signal lines, and the one or more control lines; and
a power supply circuit configured to selectively apply a plurality of potentials to the power supply line(s), wherein
each of the pixel circuits includes:
a light emitting element provided on a current path connecting the power supply line and a conductive member to which a common potential is fixedly applied, and having one end connected to the conductive member;
a drive transistor provided on the current path, and having one of conduction terminals connected to the other end of the light emitting element;
a write control transistor provided between the data signal line and a control terminal of the drive transistor, and having a control terminal connected to the scanning signal line;
a light emission control transistor provided on the current path between the power supply line and the other conduction terminal of the drive transistor, and having a control terminal connected to the control line; and
a capacitor provided between the control terminal and the conduction terminal on the light emitting element side of the drive transistor,
the drive circuit and the power supply circuit configured to: simultaneously perform initialization to the pixel circuits in the plurality of rows, simultaneously perform threshold detection to the pixel circuits in the plurality of rows, sequentially write data to the pixel circuits row by row, and perform a control to make the light emitting elements included in the pixel circuits in the plurality of rows emit light in the same period,
the power supply circuit configured to apply a first potential substantially equal to the common potential to the power supply line connected to a pixel circuit, in a period from completion of detecting threshold to start of light emission of the pixel circuit, and
the pixel circuit is configured to be controlled such that
in an initialization period, the write control transistor and the light emission control transistor are in an on state, a potential with which the drive transistor enters an on state is applied to the data signal line, and a second potential for initialization is applied to the power supply line,
in a threshold detection period, the write control transistor and the light emission control transistor are in the on state, a potential for threshold detection is applied to the data signal line, and a third potential for threshold detection is applied to the power supply line,
in a period from completion of threshold detection to start of data writing and a period from completion of data writing to start of light emission, the write control transistor and the light emission control transistor are in an off state,
in a data writing period, the write control transistor is in the on state, the light emission control transistor is in the off state, and a data potential is applied to the data signal line, and
in a light emission period, the write control transistor is in the off state, the light emission control transistor is in the on state, and a fourth potential for light emission is applied to the power supply line.

2. The display device according to claim 1, wherein the potential for threshold detection is a potential obtained by adding a threshold voltage of the drive transistor to the common potential.

3. A current drive type display device, comprising:
a plurality of pixel circuits disposed in a row direction and a column direction;
a plurality of scanning signal lines each connected to the pixel circuits in the same row;
a plurality of data signal lines each connected to the pixel circuits in the same column;
one or more control lines each connected to the pixel circuits in a plurality of rows;
one or more power supply lines each connected to the pixel circuits in the plurality of rows;
a drive circuit configured to drive the scanning signal lines, the data signal lines, and the control line(s); and
a power supply circuit configured to selectively apply a plurality of potentials to the power supply line(s), wherein
each of the pixel circuits includes:
a light emitting element provided on a current path connecting the power supply line and a conductive member to which a common potential is fixedly applied, and having one end connected to the conductive member;
a drive transistor provided on the current path, and having one of conduction terminals connected to the other end of the light emitting element and the other conduction terminal connected to the power supply line;

a first capacitor having one end connected to a control terminal of the drive transistor;

a write control transistor provided between the other end of the first capacitor and the data signal line, and having a control terminal connected to the scanning signal line;

a threshold detection transistor provided between the control terminal and the conduction terminal on the light emitting element side of the drive transistor, and having a control terminal connected to the control line; and a second capacitor provided between the other end of the first capacitor and another power supply line having a predetermined potential, the drive circuit and the power supply circuit configured to:

simultaneously perform initialization to the pixel circuits in the plurality of rows, simultaneously perform threshold detection to the pixel circuits in the plurality of rows, sequentially write data to the pixel circuits row by row, and perform a control to make the light emitting elements included in the pixel circuits in the plurality of rows emit light in the same period, the power supply circuit configured to apply a first potential substantially equal to the common potential to the power supply line connected to a pixel circuit, in a period from completion of detecting threshold to start of light emission of the pixel circuit, and the pixel circuit is configured to be controlled such that in a former part of an initialization period, the write control transistor is in an on state and the first potential is applied to the power supply line, in a latter part of the initialization period, the write control transistor is in the on state, a potential with which the drive transistor enters an on state is applied to the data signal line, and a second potential for initialization is applied to the power supply line, in a threshold detection period, the write control transistor and the threshold detection transistor are in an on state, a potential for threshold detection is applied to the data signal line, and the first potential is applied to the power supply line, in a period from completion of threshold detection to start of data writing and a period from completion of data writing to start of light emission, the write control transistor and the threshold detection transistor are in an off state, in a data writing period, the write control transistor is in the on state, the threshold detection transistor is in the off state, and a data potential is applied to the data signal line, and in a light emission period, the write control transistor and the threshold detection transistor are in the off state, and a third potential for light emission is applied to the power supply line.

4. A current drive type display device, comprising:

a plurality of pixel circuits disposed in a row direction and a column direction;

a plurality of scanning signal lines each connected to the pixel circuits in the same row;

a plurality of data signal lines each connected to the pixel circuits in the same column;

one or more control lines each connected to the pixel circuits in a plurality of rows;

one or more second control lines each connected to the pixel circuits in the plurality of rows;

one or more power supply lines each connected to the pixel circuits in the plurality of rows;

a drive circuit configured to drive the scanning signal lines, the data signal lines, the control line(s), and the second control line(s); and a power supply circuit configured to selectively apply three kinds of potentials to the power supply line(s), wherein each of the pixel circuits includes:

a light emitting element provided on a current path connecting the power supply line and a conductive member to which a common potential is fixedly applied, and having one end connected to the conductive member;

a drive transistor provided on the current path, and having one of conduction terminals connected to the other end of the light emitting element and the other conduction terminal connected to the power supply line;

a capacitor having one end connected to a control terminal of the drive transistor;

a write control transistor provided between the other end of the capacitor and the data signal line, and having a control terminal connected to the scanning signal line;

a threshold detection transistor provided between the control terminal and the conduction terminal on the light emitting element side of the drive transistor and having a control terminal connected to the second control line; and a power supply connection transistor provided between the other end of the capacitor and the power supply line or another power supply line having a predetermined potential, and having a control terminal connected to the control line, the drive circuit and the power supply circuit configured to:

simultaneously perform initialization to the pixel circuits in the plurality of rows, simultaneously perform threshold detection to the pixel circuits in the plurality of rows, sequentially write data to the pixel circuits row by row, and perform a control to make the light emitting elements included in the pixel circuits in the plurality of rows emit light in the same period, the power supply circuit configured to apply a first potential substantially equal to the common potential to the power supply line connected to the pixel circuit, in a period from completion of detecting threshold to start of light emission of the pixel circuit, and the pixel circuit is configured to be controlled such that in a former part of an initialization period, the write control transistor is in an on state, the power supply connection transistor is in an off state, and the first potential is applied to the power supply line, in a latter part of the initialization period, the write control transistor is in the on state, the power supply connection transistor is in the off state, a potential with which the drive transistor enters an on state is applied to the data signal line, and a second potential for initialization is applied to the power supply line, in a threshold detection period, the write control transistor and the threshold detection transistor are in an on state, the power supply connection transistor is in the off state, a potential for threshold detection is applied to the data signal line, and the first potential is applied to the power supply line, in a period from completion of threshold detection to start of data writing and a period from completion of data writing to start of light emission, the write control transistor and the power supply connection transistor are in the off state, in a data writing period, the write control transistor and the threshold detection transistor are in the on state, the power supply connection transistor is in the off state, and a data potential is applied to the data signal line, and in a light emission period, the write control transistor and the threshold detection transistor are in an off state, the power supply connection transistor is in an on state, and a third potential for light emission is applied to the power supply line.

5. A drive method of a current drive type display device, including a plurality of pixel circuits disposed in a row direction and a column direction, a plurality of scanning signal lines each connected to the pixel circuits in the same row, a plurality of data signal lines each connected to the pixel circuits in the same column, one or more control lines each connected to the pixel circuits in a plurality of rows, and one or more power supply lines each connected to the pixel circuits in the plurality of rows, each of the pixel circuits including a light emitting element provided on a current path connecting the power supply line and a conductive member to which a common potential is applied, and having one end connected to the conductive member, and a drive transistor provided on the current path, and having one of conduction terminals connected to the other end of the light emitting element, the method comprising:

a driving step of driving the scanning signal lines, the data signal lines, and the control line(s); and a power supply control step of selectively applying a plurality of potentials to the power supply line(s), wherein in the driving step and the power supply control step, initialization is simultaneously performed to the pixel circuits in the plurality of rows, threshold detection is simultaneously performed to the pixel circuits in the plurality of rows, data is sequentially written to the pixel circuits row by row, and a control is performed to make the light emitting elements included in the pixel circuits in the plurality of rows emit light in the same period, and in the power supply control step, a potential substantially equal to the common potential is applied to the power supply line connected to the pixel circuit, in a period from completion of detecting threshold to start of light emission of the pixel circuit, and a potential higher than the common potential is applied to the power supply line connected to the pixel circuit, in a threshold detection period and a light emission period.

* * * * *